US009505249B2

(12) United States Patent
Tamai et al.

(10) Patent No.: US 9,505,249 B2
(45) Date of Patent: Nov. 29, 2016

(54) INKJET RECORDING APPARATUS

(71) Applicant: KYOCERA Document Solutions Inc., Osaka (JP)

(72) Inventors: Hiroatsu Tamai, Osaka (JP); Takeshi Watanabe, Osaka (JP); Shinji Yoshinaga, Osaka (JP); Satoshi Tsunemi, Osaka (JP); Hidenori Takenaka, Osaka (JP); Jumpei Hobo, Osaka (JP); Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/994,789

(22) Filed: Jan. 13, 2016

(65) Prior Publication Data

US 2016/0200124 A1 Jul. 14, 2016

(30) Foreign Application Priority Data

Jan. 14, 2015 (JP) ..... 2015-005245
Jan. 14, 2015 (JP) ..... 2015-005246

(51) Int. Cl.
*B41J 2/165* (2006.01)
*B41J 29/17* (2006.01)

(52) U.S. Cl.
CPC ..... *B41J 29/17* (2013.01)

(58) Field of Classification Search
None
See application file for complete search history.

(56) References Cited

U.S. PATENT DOCUMENTS

2012/0320129 A1* 12/2012 Kawakami ..... B41J 13/10 347/44
2014/0125748 A1* 5/2014 Fletcher ..... B41J 11/007 347/104

FOREIGN PATENT DOCUMENTS

| | | | |
|---|---|---|---|
| JP | 2004-155154 | A | 6/2004 |
| JP | 2006-273444 | A | 10/2006 |
| JP | 2006-315188 | A | 11/2006 |
| JP | 2007-168400 | A | 7/2007 |
| JP | 2008-213255 | A | 9/2008 |

OTHER PUBLICATIONS

An Office Action "Notification of Reasons for Refusal" issued by the Japanese Patent Office on Jul. 19, 2016, which corresponds to Japanese Patent Application No. 2015-005246 and is related to U.S. Appl. No. 14/994,789; with English language translation.

* cited by examiner

*Primary Examiner* — Alejandro Valencia
(74) *Attorney, Agent, or Firm* — Studebaker & Brackett PC

(57) ABSTRACT

An inkjet recording apparatus includes a recording head, a conveyance section, a first voltage applying section, and a second power supplying section. The recording head ejects ink onto a recording sheet. The conveyance section conveys the recording sheet to a position of image forming by the recording head. The first power supplying section applies a voltage to the recording sheet upstream of the recording head in a conveyance direction of the recording sheet. The second power supplying section includes a plate member located between the recording head and the first power supplying section and applies a voltage to the plate member that is of opposite polarity to the voltage applied by the first power supplying section.

16 Claims, 16 Drawing Sheets

INKJET RECORDING APPARATUS

INCORPORATION BY REFERENCE

The present application claims priority under 35 U.S.C. §119 to Japanese Patent Application No. 2015-005245, filed on Jan. 14, 2015 and Japanese Patent Application No. 2015-005246, filed on Jan. 14, 2015. The contents of these applications are incorporated herein by reference in their entirety.

BACKGROUND

The present disclosure relates to an inkjet recording apparatus.

An inkjet recording apparatus that ejects ink onto a recording medium may adopt a known paper dust removal technique in order to address a problem of nozzle clogging in a recording head.

In one known example, an inkjet recording apparatus includes a paper dust collector upstream in a conveyance direction of a recording medium relative to a recording head. The paper dust collector includes a vertical wall and a downstream wall. The vertical wall stands vertically upward. The downstream wall extends downstream in the conveyance direction of the recording medium from a top end of the vertical wall.

The amount of paper dust that attaches to the recording head is reduced as a consequence of the paper dust collector collecting paper dust that arises during conveyance of the recording medium, before the paper dust reaches the recording head.

SUMMARY

An inkjet recording apparatus according to the present disclosure includes a recording head, a conveyance section, a first voltage applying section, and a second voltage applying section. The recording head ejects ink onto a recording medium. The conveyance section conveys the recording medium to a position of image forming by the recording head. The first voltage applying section applies a voltage to the recording medium upstream of the recording head in a conveyance direction of the recording medium. The second voltage applying section includes a gap forming section located between the recording head and the first voltage applying section and applies, to a lower surface of the gap forming section, a voltage that is of opposite polarity to the voltage applied by the first voltage applying section. The gap forming section forms a narrow gap in conjunction with a conveying surface of the conveyance section on which the recording medium is placed.

BRIEF DESCRIPTION OF THE DRAWINGS

FIG. 8A illustrates the charging states of the paper dust and the recording sheet at a point in time at which a leading edge of the recording sheet has passed a position under the first electrode, whereas FIG. 8B illustrates the charging states of the paper dust and the recording sheet at a point in time at which the leading edge of the recording sheet has reached a position below a central part of the plate member.

FIG. 9A illustrates the charging state of the paper dust and the recording sheet at a point in time at which the leading edge of the recording sheet has reached a position below a downstream end of the plate member in a sheet conveyance direction, whereas FIG. 9B illustrates the charging states of the paper dust and the recording sheet at a point in time at which the leading edge of the recording sheet has reached a position below a recording head.

FIG. 12A illustrates charging states of paper dust and a recording sheet at a point in time at which a leading edge of the recording sheet has passed under the electrode. FIG. 12B illustrates the charging states of the paper dust and the recording sheet at a point in time at which the leading edge of the recording sheet has reached a position below a central part of a flat plate.

FIG. 13A illustrates the charging states of the paper dust and the recording sheet at a point in time at which the leading edge of the recording sheet has reached a position below a downstream end of the flat plate in the sheet conveyance direction. FIG. 13B illustrates the charging states of the paper dust and the recording sheet at a point in time at which the leading edge of the recording sheet has reached a position below a recording head.

FIG. 15A illustrates a first embodiment of the electrode. FIG. 15B illustrates a second embodiment of the electrode.

DETAILED DESCRIPTION

Embodiment

Figure 1:
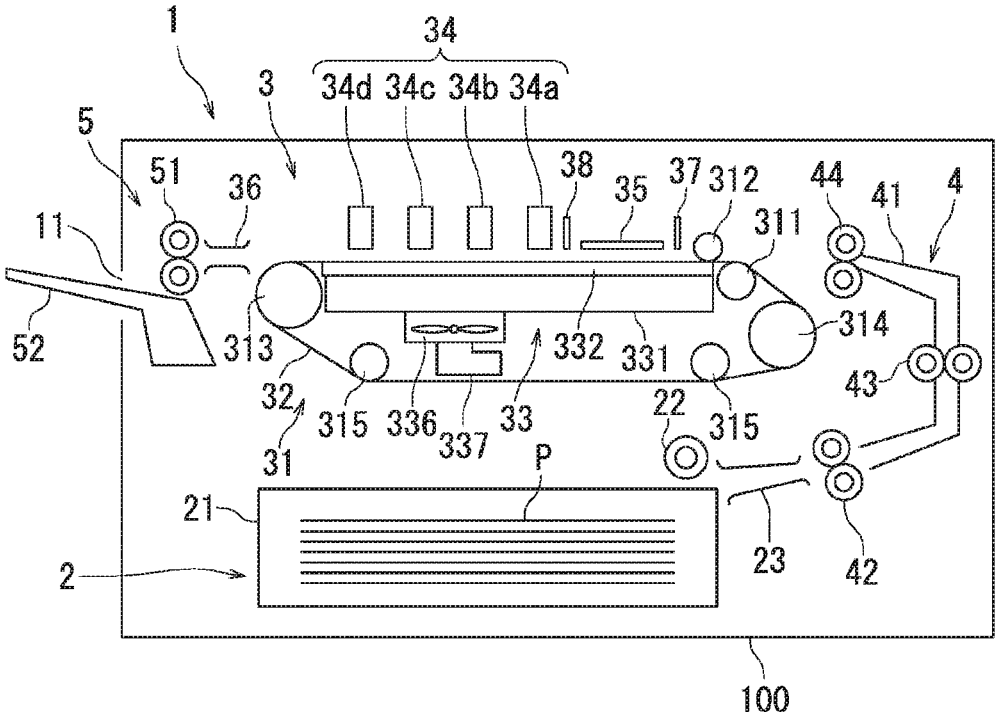
FIG. 1 illustrates configuration of an inkjet recording apparatus according to an embodiment.

The following explains an embodiment of the present disclosure with reference to the drawings (FIGS. 1-9B). Elements that are the same or equivalent are assigned the same reference signs in the drawings and are not repeatedly explained.

First, an inkjet recording apparatus 1 according to the present embodiment is explained with reference to FIG. 1. FIG. 1 illustrates configuration of the inkjet recording apparatus 1 according to the present embodiment. The inkjet recording apparatus 1 includes an apparatus housing 100, a sheet feed section 2 located in a lower part of the apparatus housing 100, an image forming section 3 located above the sheet feed section 2, a sheet conveyance section 4 located to one side (right side in FIG. 1) of the image forming section 3, and a sheet ejecting section 5 located to the other side (left side in FIG. 1) of the image forming section 3.

The sheet feed section 2 includes a sheet feed cassette 21, a sheet feed roller 22, and guide plates 23. The sheet feed cassette 21 is loaded with recording sheets P and is freely detachable from the apparatus housing 100. The sheet feed roller 22 is located above one end (right end in FIG. 1) of the sheet feed cassette 21. The guide plates 23 are located between the sheet feed roller 22 and the sheet conveyance section 4.

Recording sheets P are stored in the sheet feed cassette 21. Herein, a "recording sheet" is referred to simply as a "sheet" for convenience. Also note that a recording sheet P is equivalent to an example of a "recording medium." The sheet feed roller (pickup roller) 22 picks up an uppermost sheet P in the sheet feed cassette 21, one sheet at a time, and feeds the sheet P in a conveyance direction of the sheet P. The guide plates 23 guide the sheet P to the sheet conveyance section 4 once the sheet P is picked up by the sheet feed roller 22.

The sheet conveyance section 4 includes an substantially C-shaped sheet conveyance path 41, a pair of first conveyance rollers 42 located at an entry end of the sheet conveyance path 41, a pair of second conveyance rollers 43 located partway along the sheet conveyance path 41, and a pair of registration rollers 44 located at an exit end of the sheet conveyance path 41.

The pair of first conveyance rollers 42 is a pair of rollers (pair of feeding rollers) that feeds the sheet P in the conveyance direction of the sheet P. The pair of first conveyance rollers 42 sandwiches the sheet P fed from the sheet feed section 2 and feeds the sheet P into the sheet conveyance path 41. The pair of second conveyance rollers 43 is a pair of feeding rollers. The pair of second conveyance rollers 43 sandwiches the sheet P fed from the pair of first conveyance rollers 42 and feeds the sheet P toward the pair of registration rollers 44.

The pair of registration rollers 44 performs skew correction of the sheet P conveyed from the pair of second conveyance rollers 43. In order to synchronize timing of image formation on the sheet P and timing of conveyance of the sheet P, the pair of registration rollers 44 temporarily halts the sheet P and then feeds the sheet P to the image forming section 3 in accordance with timing of image formation on the sheet P.

The image forming section 3 includes a conveyor belt 32 and recording heads 34. The image forming section 3 conveys the sheet P fed from the pair of registration rollers 44 in a specific direction (leftward in FIG. 1) through the conveyor belt 32 and forms an image on the sheet P conveyed by the conveyor belt 32 through the recording heads 34. Detailed explanation of configuration of the image forming section 3 is provided further below with reference to FIG. 2. The image forming section 3 also includes conveyance guides 36 located downstream in the conveyance direction of the sheet P (leftward in FIG. 1) relative to the recording heads 34.

When the sheet P is ejected from the conveyor belt 32, the conveyance guides 36 guide the sheet P to the sheet ejecting section 5. The sheet ejecting section 5 includes a pair of ejection rollers 51 and an exit tray 52. The exit tray 52 is fixed to the apparatus housing 100 so as to protrude externally from an exit port 11 formed in the apparatus housing 100.

Once the sheet P has passed along the conveyance guides 36, the pair of ejection rollers 51 feeds the sheet P toward the exit port 11. The exit tray 52 guides the sheet P fed by the pair of ejection rollers 51. The sheet P fed by the pair of ejection rollers 51 is ejected externally from the apparatus housing 100 via the exit port 11, which is located in one side surface (left side surface in FIG. 1) of the apparatus housing 100. The exit tray 52 stores sheets P ejected from the exit port 11 as a stack.

Figure 2:
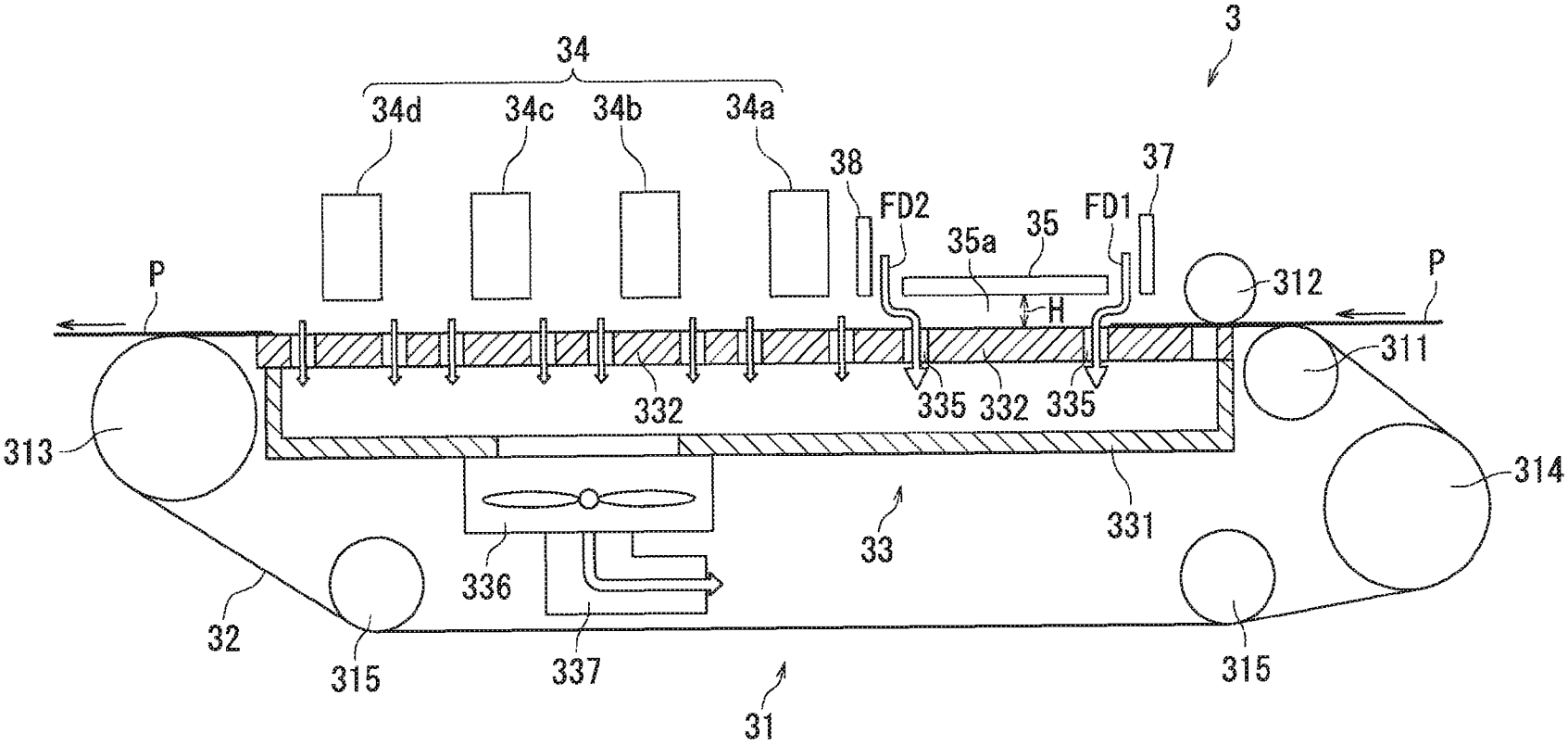
FIG. 2 illustrates configuration of an image forming section illustrated in FIG. 1.

The following explains the image forming section 3 with reference to FIG. 2. FIG. 2 illustrates configuration of the image forming section 3 illustrated in FIG. 1.

As illustrated in FIG. 2, the image forming section 3 includes a conveyance section 31, a negative pressure applying section 33, the recording heads 34, a plate member 35, a first electrode 37, and a second electrode 38. The recording heads 34 are four different types of recording heads 34*a*, 34*b*, 34*c*, and 34*d* that each include nozzles (not illustrated). Ink is ejected from the nozzles in order to form an image, such as characters or a figure, on the sheet P. The recording heads 34*a*, 34*b*, 34*c*, and 34*d* have substantially the same configuration and may therefore be referred to generally as recording heads 34.

The conveyance section 31 conveys the sheet P in a specific direction (leftward in FIG. 2). The conveyance section 31 includes a belt-speed detecting roller 311, a sheet placement roller 312, a drive roller 313, a tension roller 314, a pair of guide rollers 315, and the conveyor belt 32.

The conveyance section 31 is located opposite to the four types of recording heads 34 (34*a*, 34*b*, 34*c*, and 34*d*) inside of the apparatus housing 100. The conveyor belt 32 is stretched around the belt-speed detecting roller 311, the drive roller 313, the tension roller 314, and the pair of guide rollers 315. The conveyor belt 32 is driven in the conveyance direction of the sheet P (counterclockwise in FIG. 2) to convey the sheet P. The conveyor belt 32 is equivalent to an example of an "endless belt."

The tension roller 314 applies tension to the conveyor belt 32 so that the conveyor belt 32 does not sag.

The belt-speed detecting roller 311 is located upstream in the conveyance direction of the sheet P (rightward in FIG. 2) relative to the negative pressure applying section 33 and rotates through friction with the conveyor belt 32. The belt-speed detecting roller 311 includes a pulse plate (not illustrated) that rotates integrally with the belt-speed detecting roller 311. The circulation speed of the conveyor belt 32 is detected by measuring the rotational speed of the pulse plate.

The drive roller 313 is located downstream in the conveyance direction of the sheet P (leftward in FIG. 1) relative to the negative pressure applying section 33. The drive roller 313 preferably functions in conjunction with the belt-speed detecting roller 311 to maintain flatness of the conveyor belt 32 at positions opposite to the recording heads 34.

The drive roller 313 is rotationally driven by a motor (not illustrated) such that the drive roller 313 causes circulation of the conveyor belt 32 in a direction corresponding to counterclockwise in FIG. 2.

The pair of guide rollers 315 is located below the negative pressure applying section 33 and creates a space below the negative pressure applying section 33. Such positioning of the pair of guide rollers 315 can prevent contact between the conveyor belt 32 and the negative pressure applying section 33 below the negative pressure applying section 33.

The four types of recording heads 34 (34*a*, 34*b*, 34*c*, and 34*d*) are arranged from upstream to downstream in the conveyance direction of the sheet P. The recording heads 34*a*, 34*b*, 34*c*, and 34*d* each include nozzles (not illustrated) that are arranged in rows in a width direction of the conveyor belt 32 (direction perpendicular to the plane of FIG. 2). Each of the recording heads 34*a*, 34*b*, 34*c*, and 34*d* is referred to as a line head. In other words, the inkjet recording apparatus 1 is a line head inkjet recording apparatus.

The negative pressure applying section 33 causes the sheet P to be sucked onto the conveyor belt 32 by applying negative pressure to the sheet P through the conveyor belt 32. The negative pressure applying section 33 is located at a rear surface side (below in FIG. 2) of the conveyor belt 32 such as to be opposite to the four types of recording heads 34 with the conveyor belt 32 in-between. The negative pressure applying section 33 includes an air flow chamber 331, a guide member 332 that covers an opening at the top of the air flow chamber 331, a negative pressure creating section 336, and a gas outlet 337.

The sheet placement roller 312 is a driven roller. The sheet placement roller 312 is located opposite to the guide member 332 with the conveyor belt 32 in-between. The sheet placement roller 312 guides a sheet P that has been fed from the pair of registration rollers 44 onto the conveyor belt 32 so that the sheet P is sucked onto the conveyor belt 32.

The guide member 332 supports the sheet P through the conveyor belt 32. The guide member 332 has through holes 335. The guide member 332 is for example made from a metallic material. Specifically, the guide member 332 can be made from die-cast aluminum or pressed metal plate. The guide member 332 is grounded.

Although the guide member 332 in the present embodiment is described as part of the negative pressure applying section 33 for convenience, the guide member 332 may alternatively be described as part of the conveyance section 31 because the guide member 332 supports the conveyor belt 32 as described above.

The air flow chamber 331 is a box-shaped member that is a tube having an open top end and a closed bottom end. An upper surface of a side wall of the air flow chamber 331 is fixed to the guide member 332. The negative pressure creating section 336 is located below the air flow chamber 331. The gas outlet 337 is located at a downstream side of the negative pressure creating section 336 in terms of air flow (below in FIG. 2). Driving of the negative pressure creating section 336 creates negative pressure inside of the air flow chamber 331. The negative pressure sucks the sheet P onto the conveyor belt 32 through the guide member 332 and the conveyor belt 32.

The negative pressure creating section 336 is a fan or the like that creates negative pressure inside of the air flow chamber 331. However, the negative pressure creating section 336 is not limited to being a fan and may, for example, alternatively be a vacuum pump.

The plate member 35 is located upstream in the conveyance direction of the sheet P (rightward in FIG. 2) relative to the recording heads 34. In other words, the plate member 35 is located between the recording head 34*a* and the sheet placement roller 312. The plate member 35 forms a narrow gap 35*a* in conjunction with an upper surface of the conveyor belt 32. The plate member 35 is equivalent to an example of a "gap forming section."

The first electrode 37 is located upstream in the conveyance direction of the sheet P (rightward in FIG. 2) relative to the plate member 35. The first electrode 37 charges the sheet P and paper dust PD. The second electrode 38 is located between the recording head 34*a* and the plate member 35. The second electrode 38 removes static from the sheet P that has been charged by the first electrode 37. The first electrode 37 and the second electrode 38 are explained in detail with reference to FIGS. 7, 8A, 8B, 9A, and 9B. The first electrode 37 is equivalent to part of a "first voltage applying section." The plate member 35 is equivalent to part of a "second voltage applying section." The second electrode 38 is equivalent to part of a "third voltage applying section."

The following explains operation of the inkjet recording apparatus 1 with reference to FIG. 1. A sheet P is picked up from the sheet feed cassette 21 by the sheet feed roller 22. The picked-up sheet P is guided to the pair of first conveyance rollers 42 by the guide plates 23.

Thereafter, the sheet P is fed into the sheet conveyance path 41 by the pair of first conveyance rollers 42 and is conveyed in the conveyance direction of the sheet P by the pair of second conveyance rollers 43. The sheet P is halted upon coming into contact with the pair of registration rollers 44 which performs skew correction on the sheet P. Next, the sheet P is fed to the image forming section 3 by the pair of registration rollers 44 in accordance with timing of image formation.

The sheet P is guided onto the conveyor belt 32 by the sheet placement roller 312 such as to be sucked onto the conveyor belt 32. The sheet P is preferably guided onto the conveyor belt 32 such that the center of the sheet P in a width direction thereof coincides with the center of the conveyor belt 32 in the width direction thereof. The sheet P covers some of the numerous suction holes 321 (refer to FIG. 3) in the conveyor belt 32. The negative pressure applying section 33 sucks air through the guide member 332 and the conveyor belt 32 and creates negative pressure in the air flow chamber 331. Through the above, the negative pressure acts on the sheet P to suck the sheet P onto the conveyor belt 32. The sheet P is conveyed in the conveyance direction of the sheet P as the conveyor belt 32 moves.

The sheet P is conveyed by the conveyor belt 32 such that all portions of the sheet P sequentially become positioned opposite to the four types of recording heads 34*a*, 34*b*, 34*c*, and 34*d*. While the sheet P is being conveyed by the conveyor belt 32 as described above, the four types of recording heads 34*a*, 34*b*, 34*c*, and 34*d* each eject ink of a corresponding color onto the conveyed sheet P. Through the above, an image is formed on the sheet P.

The sheet P is conveyed from the conveyor belt 32 to the conveyance guides 36. Once the sheet P has passed along the conveyance guides 36, the sheet is fed toward the exit port 11 by the pair of ejection rollers 51 and is guided by the exit tray 52 so as to be ejected externally from the apparatus housing 100 via the exit port 11.

Figure 3:
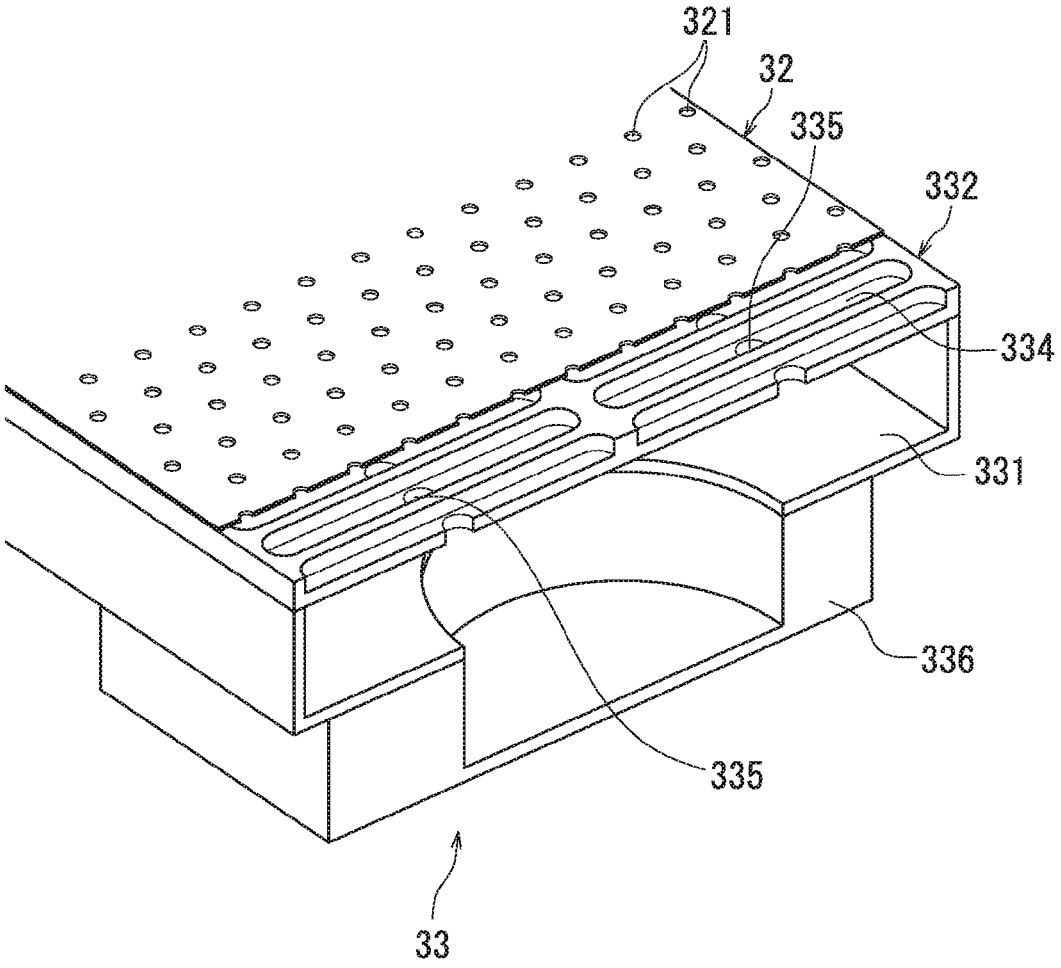
FIG. 3 is a cut-away perspective view illustrating configuration of a conveyor belt, a guide member, and a negative pressure applying section illustrated in FIG. 2.

The following explains configuration of the conveyor belt 32, the guide member 332, and the negative pressure applying section 33 with reference to FIG. 3. FIG. 3 is a cut-away perspective view illustrating configuration of the conveyor belt 32, the guide member 332, and the negative pressure applying section 33 illustrated in FIG. 2.

As illustrated in FIG. 3, the conveyor belt 32, the guide member 332, the air flow chamber 331, and the negative pressure creating section 336 are located in order from top to bottom. The conveyor belt 32 has numerous suction holes 321.

The following explains the suction holes 321 in the conveyor belt 32. As illustrated in FIG. 3, the numerous suction holes 321 are arranged at substantially equal intervals in the conveyor belt 32. The suction holes 321 each have a diameter of, for example, 2 mm and are arranged at intervals of, for example, 8 mm.

Grooves 334 are located in an upper surface of the guide member 332 (surface at a side corresponding to the conveyor belt 32). Each of the grooves 334 has an oval shape that is elongated in the conveyance direction of the sheet P.

Figure 4:
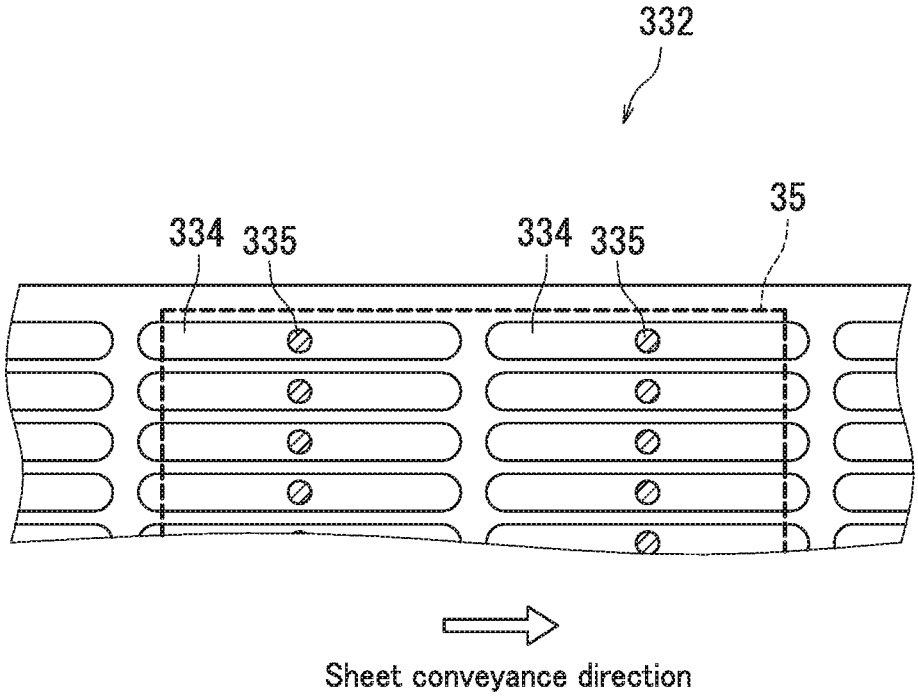
FIG. 4 is a plan view illustrating configuration of the guide member illustrated in FIG. 3.

The following explains the grooves 334 and the through holes 335 in the guide member 332 with reference to FIG. 4. FIG. 4 is a plan view illustrating configuration of the guide member 332 illustrated in FIG. 3. As illustrated in FIG. 4, rows of grooves 334—each groove 334 has an oval shape that is elongated in the conveyance direction of the sheet P (left-right direction in FIG. 4)—are located in the guide member 332 in a width direction of the guide member 332 (up-down direction in FIG. 4). In each of the grooves 334, a through hole 335 that extends through the guide member 332 in a thickness direction thereof is located at a substantially central position in the conveyance direction of the sheet P (left-right direction in FIG. 4). The through holes 335 each have a circular cross-section.

A dashed line in FIG. 4 indicates a projected position of the plate member 35 on the guide member 332. Relative to the projection of the plate member 35 on the guide member 332, one row of through holes 335 is located on an upstream side in the conveyance direction of the sheet P (left side in FIG. 4) and another row of through holes 335 is located on a downstream side in the conveyance direction of the sheet P (right side in FIG. 4). Grooves 334 connected to the through holes 335 at the upstream side in the conveyance direction of the sheet P (left side in FIG. 4) each extend further upstream in the conveyance direction of the sheet P than an upstream edge in the conveyance direction of the sheet P (left edge in FIG. 4) of the projection of the plate member 35. Likewise, grooves 334 connected to the through holes 335 at the downstream side in the conveyance direction of the sheet P (right side in FIG. 4) each extend further downstream in the conveyance direction of the sheet P than a downstream edge in the conveyance direction of the sheet P (right edge in FIG. 4) of the projection of the plate member 35.

Figure 5A:
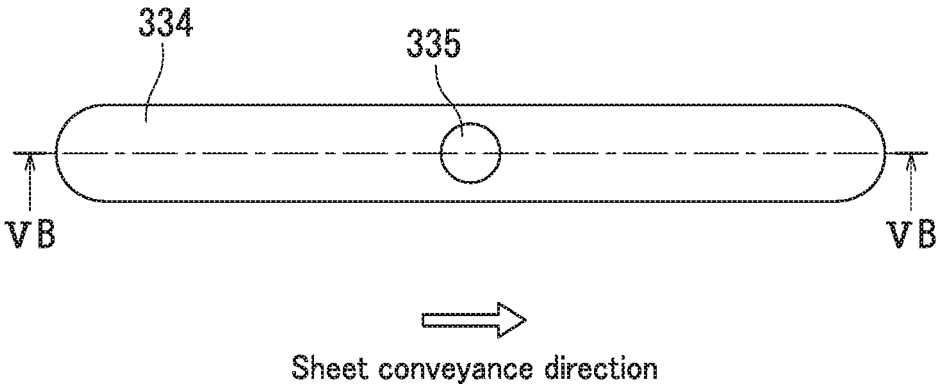
FIG. 5A is a plan view illustrating configuration of a groove and a through hole in the guide member illustrated in FIG. 4.
Figure 5B:
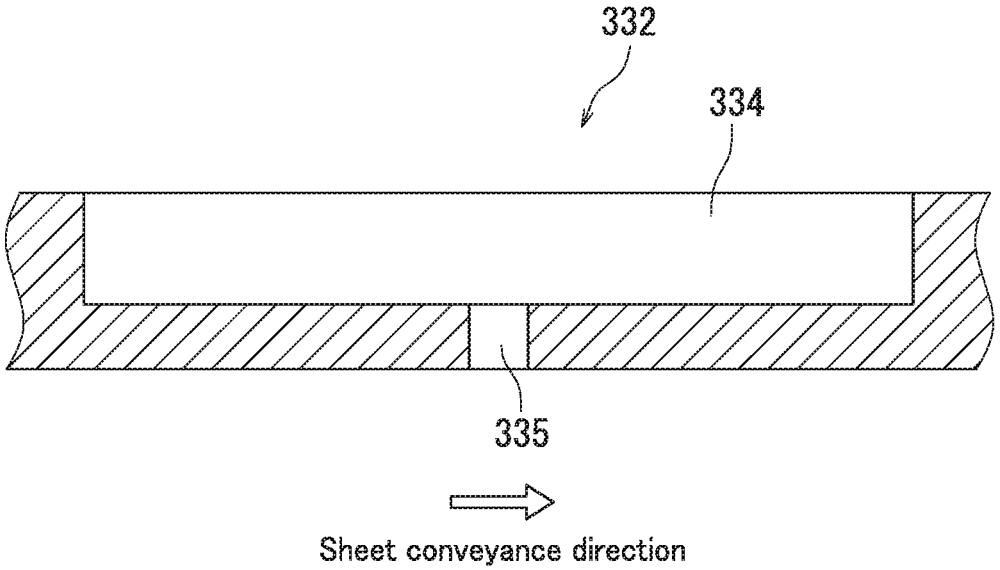
FIG. 5B is a cross-sectional view along line VB-VB illustrating configuration of the groove and the through hole illustrated in FIG. 5A.

The following explains the grooves 334 and the through holes 335 in the guide member 332 with reference to FIGS. 5A and 5B. FIG. 5A is a plan view illustrating configuration of the groove 334 and the through hole 335 in the guide member 332 illustrated in FIG. 4, whereas FIG. 5B is a cross-sectional view along a line VB-VB illustrating configuration of the groove 334 and the through hole 335 illustrated in FIG. 5A.

As illustrated in FIG. 5A, the through hole 335 is located substantially centrally in the groove 334 in the conveyance direction of the sheet P (left-right direction in FIG. 5A) and passes through the guide member 332 in a thickness direction thereof. As illustrated in FIG. 5B, the groove 334 is connected to the through hole 335 and, as a result, negative pressure applied by the air flow chamber 331 through the through hole 335 also acts in a region in which the groove 334 is present.

The following explains a positional relationship between the suction holes 321 in the conveyor belt 32 and the grooves 334 in the guide member 332 with reference to FIG. 3. The conveyor belt 32 has rows of suction holes 321 arranged in the width direction of the conveyor belt 32 (direction perpendicular to the conveyance direction of the sheet P) with each of the rows being composed of numerous suction holes 321 arranged in the conveyance direction of the sheet P. The rows of suction holes 321 are arranged such that the suction holes 321 are in a staggered formation. As illustrated in FIG. 3, the rows of suction holes 321 in the conveyor belt 32 are arranged in correspondence with the rows of grooves 334.

Each of the grooves 334 is located opposite to at least two of the suction holes 321. The suction holes 321 located opposite to each of the grooves 334 change one by one as the conveyor belt 32 moves.

The air flow chamber 331 in which negative pressure is created by the negative pressure creating section 336 is connected to the suction holes 321 in the conveyor belt 32 via the through holes 335 and the grooves 334 in the guide member 332.

As explained above, the sheet P can be sucked onto the conveyor belt 32 during conveyance through application of negative pressure to the suction holes 321 in the conveyor belt 32.

Figure 6:
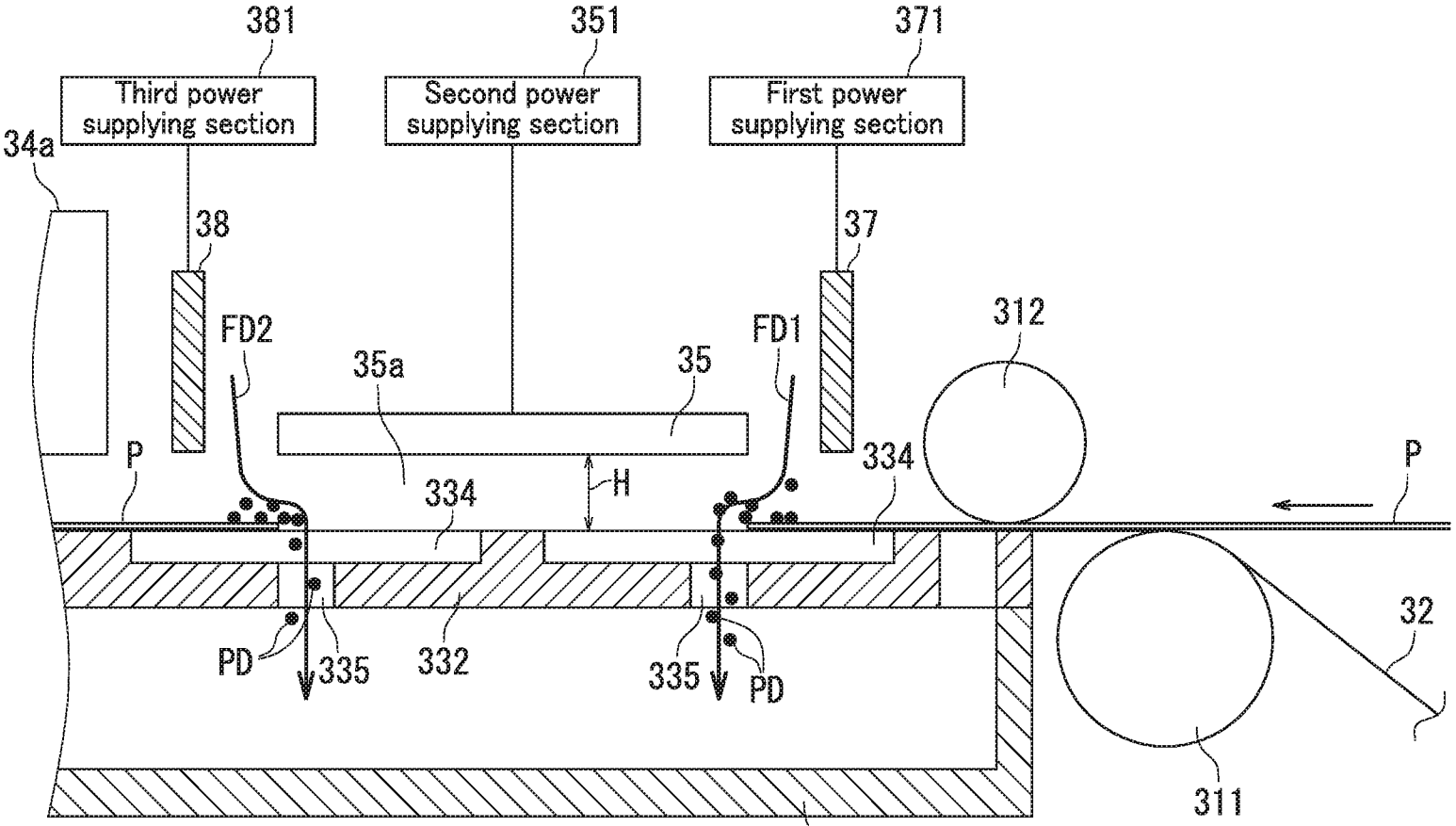
FIG. 6 illustrates configuration around a plate member illustrated in FIG. 2.

The following explains configuration around the plate member 35 with reference to FIG. 6. FIG. 6 illustrates configuration around the plate member 35 illustrated in FIG. 2.

A distance H across the narrow gap 35*a* in a direction perpendicular to the upper surface of the conveyor belt 32 is set such that air flowing into the narrow gap 35*a* from a surrounding region has a higher flow velocity in the narrow gap 35*a* than before flowing into the narrow gap 35*a*. In other words, the distance H is a width (distance) of the narrow gap 35*a* in a vertical direction. More specifically, the lower surface of the plate member 35 and the upper surface of the conveyor belt 32 in conjunction form the narrow gap 35*a* having the distance H in the up-down direction which is set as no greater than a threshold distance HS (for example, 3 mm). The plate member 35 is a conductor (for example, a metal such as stainless steel). The upper surface of the conveyor belt 32, which is in contact with the guide member 332, is equivalent to an example of a "conveyance surface on which a recording medium is placed." In the present embodiment, the distance H across the narrow gap 35*a* in the up-down direction is, for example, 2 mm.

Although the above explanation with reference to FIG. 6 was given for a situation in which the thickness of the sheet P is sufficiently thin relative to the distance H across the narrow gap 35*a* in the up-down direction, the distance H across the narrow gap 35*a* in the up-down direction is preferably adjusted in accordance with the thickness of the sheet P. More specifically, the plate member 35 is for example preferably raised and lowered in accordance with the thickness of the sheet P such that a distance between an upper surface of the sheet P and the lower surface of the plate member 35 (for example, 2 mm) remains substantially constant.

The following explains air flow around the narrow gap 35*a*. Air flows into the air flow chamber 331 from the narrow gap 35*a*, via the suction holes 321 and the through holes 335, as a result of the air flow chamber 331 being placed in a negative pressure state relative to atmospheric pressure (for example, with a pressure difference relative to atmospheric pressure of approximately 0.005 atm≈approximately 500 Pa) by the negative pressure creating section 336. As a consequence of air flowing into the air flow chamber 331 from the narrow gap 35*a*, air flows into the narrow gap 35*a* from upstream in the conveyance direction of the sheet P (rightward in FIG. 6) relative to the plate member 35 and downstream in the conveyance direction of the sheet P (leftward in FIG. 6) relative to the plate member 35.

Therefore, air flows along arrows FD1 and FD2 illustrated in FIG. 6. The flow velocity of the air increases in the narrow gap 35*a* as a result of the distance H across the narrow gap 35*a* in the up-down direction being set as no greater than the preset threshold distance HS. The flow velocity in the narrow gap 35*a* is, for example, preferably at least 6.0 m/sec.

As explained above, air flowing along the arrow FD1 flows from upstream to downstream in the conveyance direction of the sheet P (leftward in FIG. 6) in the narrow gap 35*a*. Therefore, paper dust PD attached to a leading edge of the sheet P (left edge in FIG. 6) can be removed and collected inside of the air flow chamber 331. In addition, air flowing along the arrow FD2 flows from downstream to upstream in the conveyance direction of the sheet P (rightward in FIG. 6) in the narrow gap 35*a*. Therefore, paper dust PD attached to a trailing edge of the sheet P (right edge in FIG. 6) can be removed and collected inside of the air flow chamber 331. The above enables effective removal of paper dust PD attached to the sheet P.

As explained above with reference to FIG. 4, the grooves 334 are present at positions opposite to the plate member 35. Therefore, negative pressure applied from the air flow chamber 331 via the through holes 335 also acts in regions in which the grooves 334 are present. As a result, air can flow more easily along the arrows FD1 and FD2 illustrated in FIG. 6 and paper dust PD can be removed more effectively.

As illustrated in FIG. 6, a first power supplying section 371, a second power supplying section 351, and a third power supplying section 381 are provided. The first power supplying section 371 applies a voltage to the sheet P, via the first electrode 37, that is of the same polarity as a charging polarity of the recording heads. More specifically, in a situation in which the recording heads 34 are negatively charged, the first power supplying section 371 applies a voltage of, for example, −2.2 kV to the first electrode 37, relative to the grounded guide member 332 as a reference. In the above situation, the sheet P and paper dust PD are charged to, for example, −70 V.

The second power supplying section 351 applies a voltage to the plate member 35 that is of opposite polarity to the voltage applied by the first power supplying section 371. More specifically, in a situation in which the recording heads 34 are negatively charged, the second power supplying section 351 applies a voltage of, for example, +3.0 kV to the plate member 35, relative to the grounded guide member 332 as a reference. The plate member 35 is positively charged as a result.

As a consequence of the paper dust PD being negatively charged and the plate member 35 being positively charged as described above, Coulomb forces cause the paper dust PD to attach to the plate member 35. Therefore, the paper dust PD can be more effectively removed.

Although the majority of paper dust PD attached to the leading and trailing edges of the sheet P is collected inside of the air flow chamber 331 as described above, through air flowing along the arrows FD1 and FD2, some paper dust PD is not collected inside of the air flow chamber 331. For example, in the case of a central portion of the sheet P, it is difficult for air to flow along the arrows FD1 and FD2 because the sheet P is covering the grooves 334 (through holes 335). However, paper dust PD attached to the central portion of the sheet P can be removed more effectively as a result of the paper dust PD attaching to the plate member 35 due to Coulomb forces.

The third power supplying section 381 applies a voltage to the sheet P, via the second electrode 38, that is of opposite polarity to the voltage applied by the first power supplying section 371. More specifically, in a situation in which the recording heads 34 are negatively charged, the third power supplying section 381 applies a voltage of, for example, +3.0 kV to the second electrode 38, relative to the grounded guide member 332 as a reference. In the above situation, static is removed from the sheet P and the paper dust PD. In other words, electrical charge causing charging of the sheet P and the paper dust PD to −70 V moves from the sheet P and the paper dust PD to the grounded guide member 332.

Therefore, even if the paper dust PD is conveyed below the recording heads 34, the paper dust PD can be restricted from attaching to the recording heads 34 due to Coulomb forces because the paper dust PD is not charged. Consequently, the paper dust PD can be effectively restricted from attaching to the recording heads 34.

Although the present embodiment is explained for a configuration in which the third power supplying section 381 removes static from the sheet P, the aforementioned configuration is not a limitation. For example, a configuration in which the third power supplying section 381 adjusts an electrical potential of the sheet P to substantially the same level as an electrical potential of the recording heads 34 is particularly preferable. In a situation in which the electrical potential of the sheet P is substantially the same level as the electrical potential of the recording heads 34, the paper dust PD can be more reliably restricted from attaching to the recording heads 34 due to Coulomb forces. Consequently, the paper dust PD can be more effectively restricted from attaching to the recording heads 34.

The recording heads 34 are negatively charged in a situation in which nozzle surfaces (not illustrated) of the recording heads 34 are fluorine coated. In the above situation, the third power supplying section 381 applies a voltage of, for example, +2.5 kV to the second electrode 38 in order that the electrical potential of sheet P becomes of substantially the same level as the electrical potential of the recording heads 34 (for example, −40 V).

Figure 7:
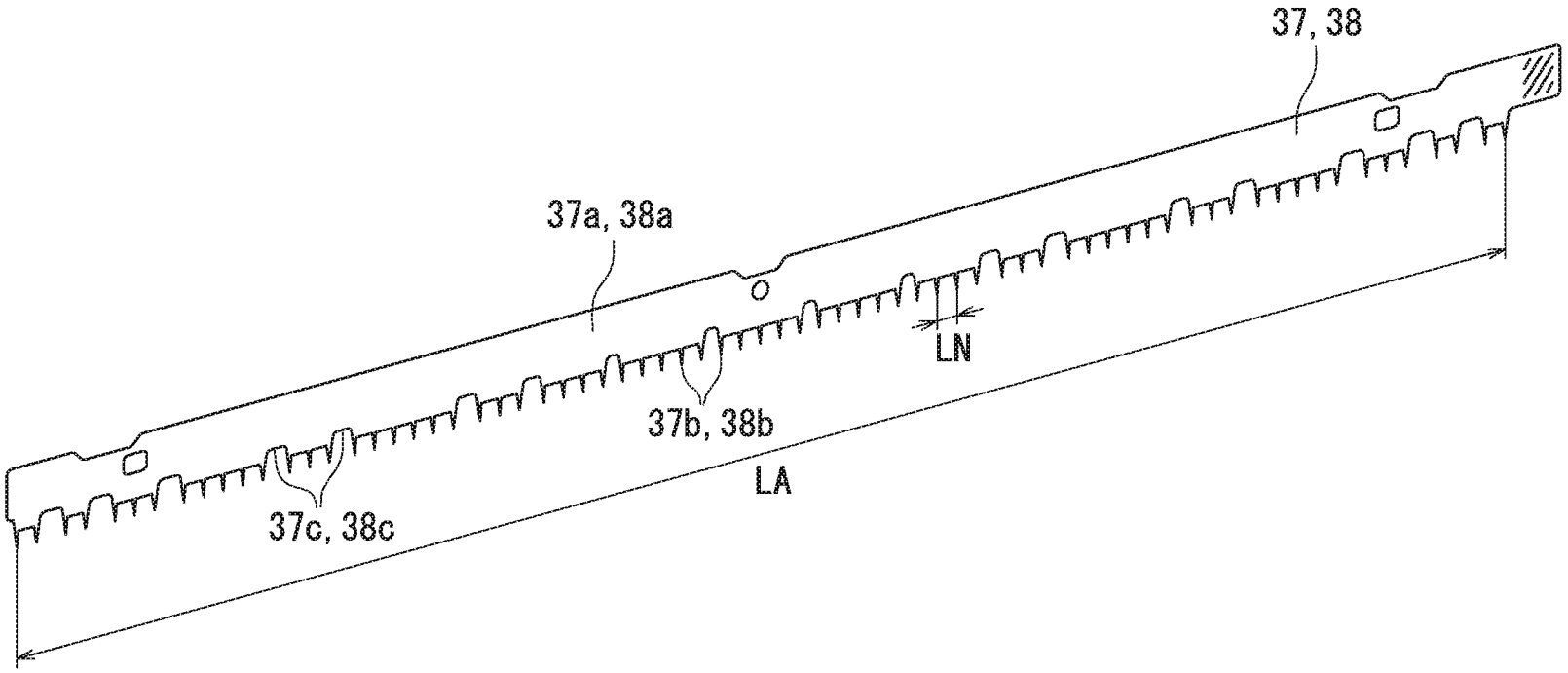
FIG. 7 is a perspective view illustrating an example of a first electrode and a second electrode illustrated in FIG. 6.

The following refers to FIG. 7 to explain needle electrodes forming the first electrode 37 and the second electrode 38 illustrated in FIG. 6. FIG. 7 is a perspective view illustrating an example of the first electrode 37 and the second electrode 38 illustrated in FIG. 6. Note that as the first electrode 37 and the second electrode 38 have substantially the same configuration, explanation of the first electrode 37 is provided for the sake of convenience. As illustrated in FIG. 7, the first electrode 37 is a so-called "needle electrode."

More specifically, the first electrode 37 includes a base 37*a* and discharge portions 37*b*. The base 37*a* is a plate member that is made from a metal such as stainless steel. The discharge portions 37*b* are arranged along a lower edge of the base 37*a* (edge close to the guide member 332) and each have a sharp tip (end close to the guide member 332) like a needle. The base 37*a* and the discharge portions 37*b* have an integrated structure.

The discharge portions 37*b* are arranged at substantially equal intervals such that an interval LN between adjacent discharge portions 37*b* is, for example, 4 mm. The base 37*a* has recesses 37*c* that are used to support the first electrode 37. A distance LA between discharge portions 37*b* located at opposite ends of the base 37*a* is at least as large as the width of a largest sheet P on which the inkjet recording apparatus 1 can perform printing.

As a result of the first electrode 37 and the second electrode 38 being needle electrodes as described above, the paper dust PD and the sheet P can be efficiently charged.

Although the present embodiment is explained for a configuration in which the first electrode 37 and the second electrode 38 are needle electrodes, the aforementioned configuration is not a limitation. For example, in an alternative configuration, the first electrode 37 and the second electrode 38 may be driven rollers that are driven in contact with the conveyor belt 32. In the above configuration, the paper dust PD and the sheet P can be charged more efficiently because electricity is passed through the first electrode 37 and the second electrode 38 while in contact with the sheet P.

Figure 8A:
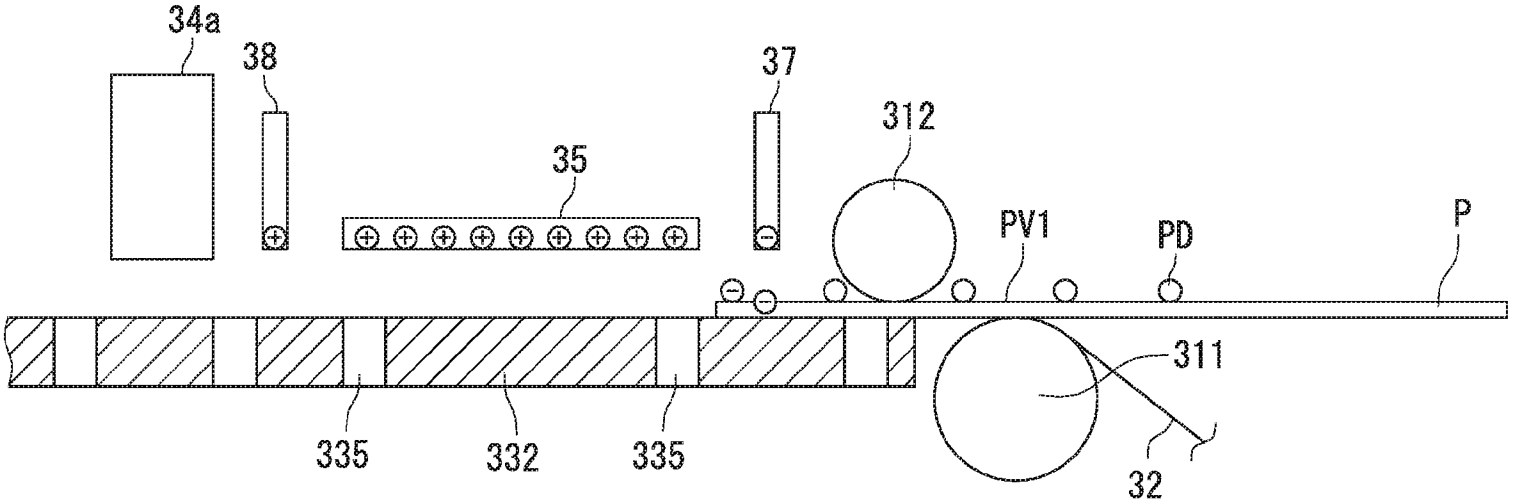
FIGS. 8A and 8B illustrate an example of change in charging states of paper dust and a recording sheet by the first electrode and the second electrode illustrated in FIG. 6.
Figure 8B:
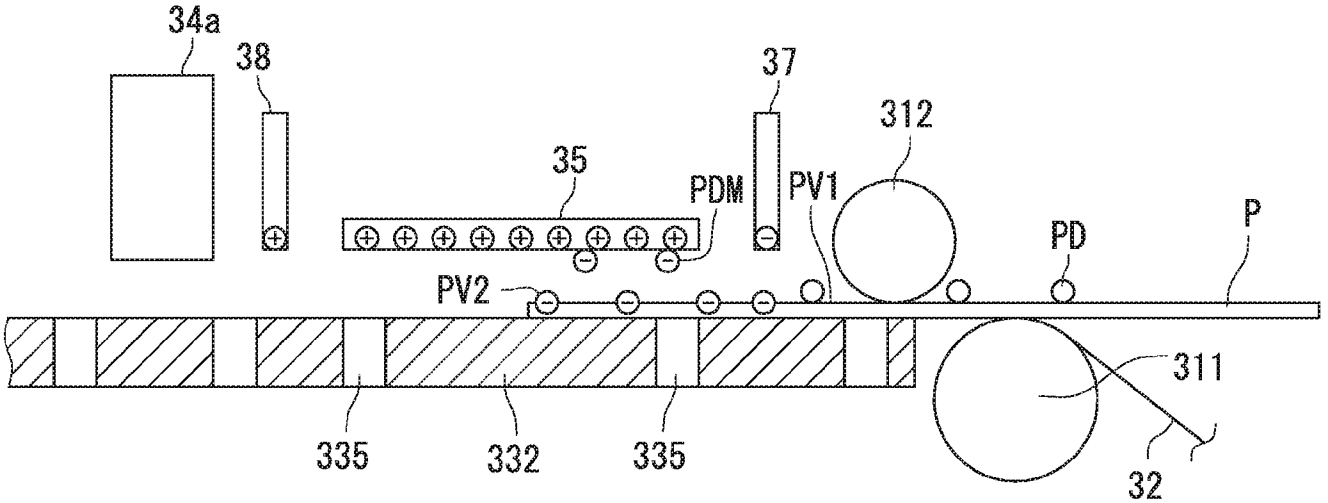
Figure 9A:
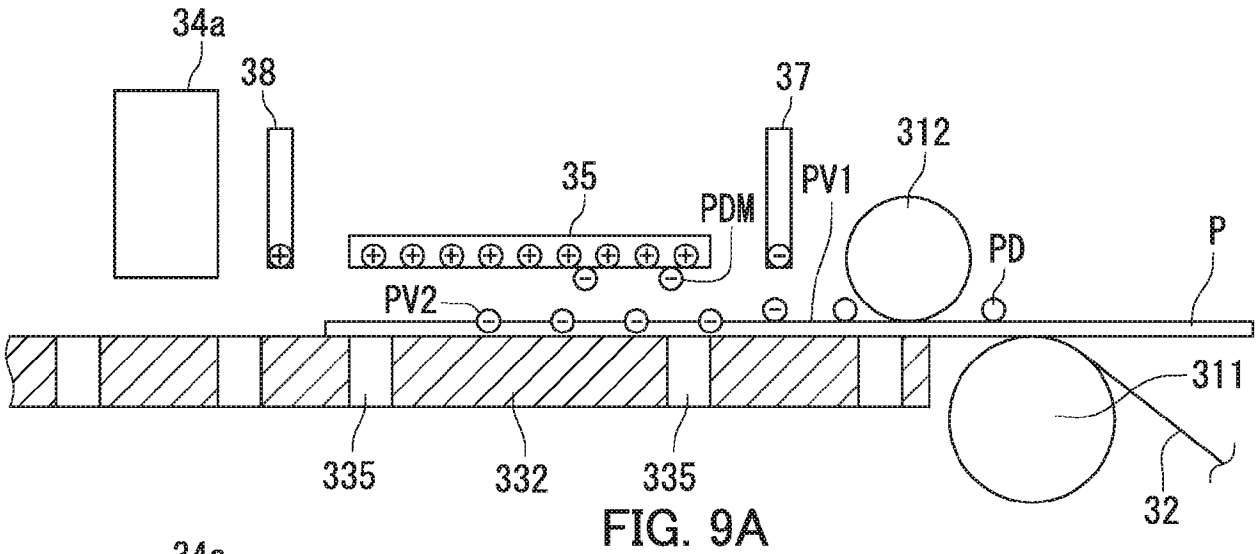
FIGS. 9A and 9B illustrate another example of change in the charging states of the paper dust and the recording sheet by the first electrode and the second electrode illustrated in FIG. 6.
Figure 9B:
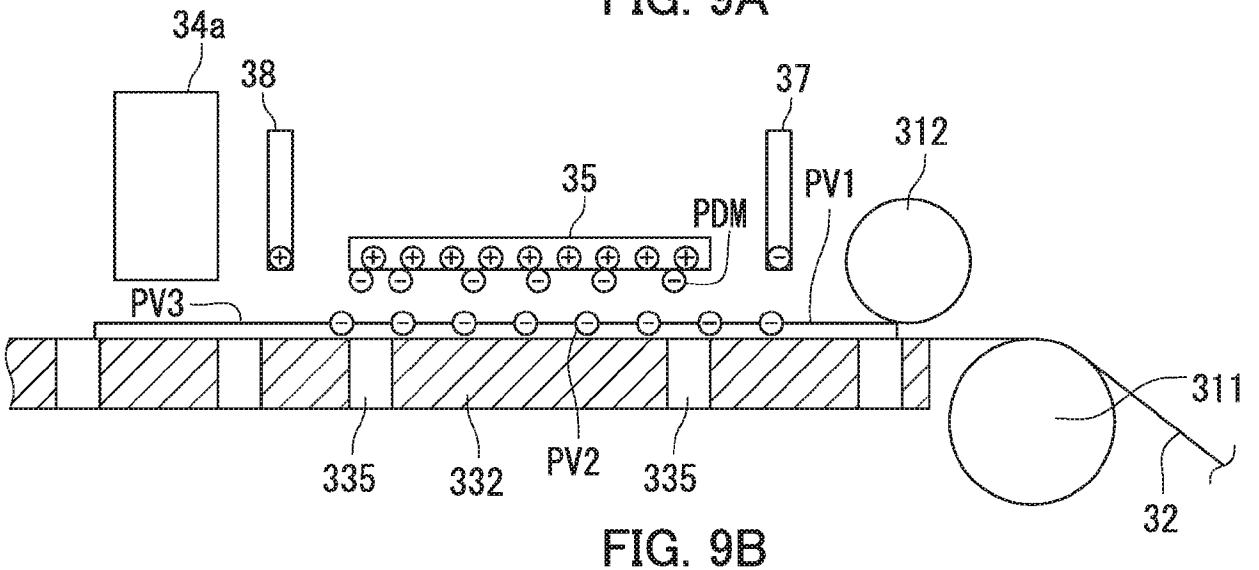

The following refers to FIGS. 8A, 8B, 9A, and 9B to explain change in charging states of the paper dust PD and the sheet P and movement of the paper dust PD as the sheet P is conveyed in the conveyance direction. FIGS. 8A and 8B illustrate an example of change in the charging states of the paper dust PD and the sheet P by the first electrode 37 and the second electrode 38 illustrated in FIG. 6. FIG. 8A illustrates the charging states of the paper dust PD and the sheet P at a point in time at which the leading edge of the sheet P has passed a position below the first electrode 37, whereas FIG. 8B illustrates the charging states of the paper dust PD and the sheet P at a point in time at which the leading edge of the sheet P has reached a position below a central part of the plate member 35. FIGS. 9A and 9B illustrate another example of change in the charging states of the paper dust PD and the sheet P by the first electrode 37 and the second electrode 38 illustrated in FIG. 6. FIG. 9A illustrates the charging states of the paper dust PD and the sheet P at a point in time at which the leading edge of the sheet P has reached a position below a downstream end of the plate member 35 in the conveyance direction, whereas FIG. 9B illustrates the charging states of the paper dust PD and the sheet P at a point in time at which the leading edge of the sheet P has reached a position below the recording head 34*a*. The following explains FIGS. 8A, 8B, 9A, and 9B in order.

As explained with reference to FIG. 6, the first electrode 37 has an applied voltage of, for example, −2.2 kV relative to the grounded guide member 332 as a reference. The plate member 35 has an applied voltage of, for example, +3 kV relative to the grounded guide member 332 as a reference. The second electrode 38 has an applied voltage of, for example, +3.0 kV relative to the grounded guide member 332 as a reference.

FIG. 8A illustrates the charging states of the paper dust PD and the sheet P at a point in time at which the leading edge of the sheet P (left edge in FIG. 8A) has passed the position below the first electrode 37. In the present embodiment, the paper dust PD and the sheet P are not charged prior to reaching the position below the first electrode 37. In other words, the sheet P has a neutral (±0) charging polarity PV1 prior to reaching the position below the first electrode 37. When the paper dust PD and the sheet P pass below the first electrode 37, the paper dust PD and the sheet P are negatively charged by the first electrode 37. The negatively charged paper dust PD is referred to as "paper dust PDM." After passing under the first electrode 37, the sheet P has a negative charging polarity PV2. Negative charging of the sheet P is indicated in FIGS. 8A, 8B, 9A, and 9B by a minus sign enclosed in a circle shown on the upper surface of the sheet P.

FIG. 8B illustrates the charging states of the paper dust PD and the sheet P at a point in time at which the leading edge of the sheet P has reached the position below the central part of the plate member 35. The negatively charged paper dust PDM is attracted toward the positively charged plate member 35 by Coulomb forces and attaches to the plate member 35. On the other hand, the charging state of the sheet P does not change because discharge does not occur between the plate member 35 and the guide member 332. In other words, the sheet P still has the negative charging polarity PV2 after reaching the position below the central part of the plate member 35.

FIG. 9A illustrates the charging states of the paper dust PD and the sheet P at a point in time at which the leading edge of the sheet P has reached the position below the downstream end of the plate member 35 in the sheet conveyance direction. In the same way as in FIG. 8B, the negatively charged paper dust PDM is attracted toward the positively charged plate member 35 by Coulomb forces and attaches to the plate member 35. On the other hand, the charging state of the sheet P does not change and the sheet P remains negatively charged.

FIG. 9B illustrates the charging states of the paper dust PD and the sheet P at a point in time at which the leading edge of the sheet P has reached the position below the recording head 34*a*. When the paper dust PD and the sheet P pass below the second electrode 38, static is removed from the paper dust PD and the sheet P by the second electrode 38. In other words, the paper dust PD and the sheet P have a neutral (±0) charging polarity PV3 after passing below the second electrode 38.

As explained above, the paper dust PD is negatively charged by the first electrode 37 and is attracted toward the positively charged plate member 35 by Coulomb forces, resulting in attachment of the paper dust PD to the plate member 35. Therefore, the paper dust PD can be more effectively removed.

After the sheet P is negatively charged by the first electrode 37, static is removed from the sheet P by the second electrode 38. Therefore, even if the paper dust PD is conveyed below the recording heads 34, the paper dust PD can be restricted from attaching to the recording heads 34 due to Coulomb forces because the paper dust PD is not charged. Consequently, the paper dust PD can be effectively restricted from attaching to the recording heads 34.

<Variation>

Figure 10:
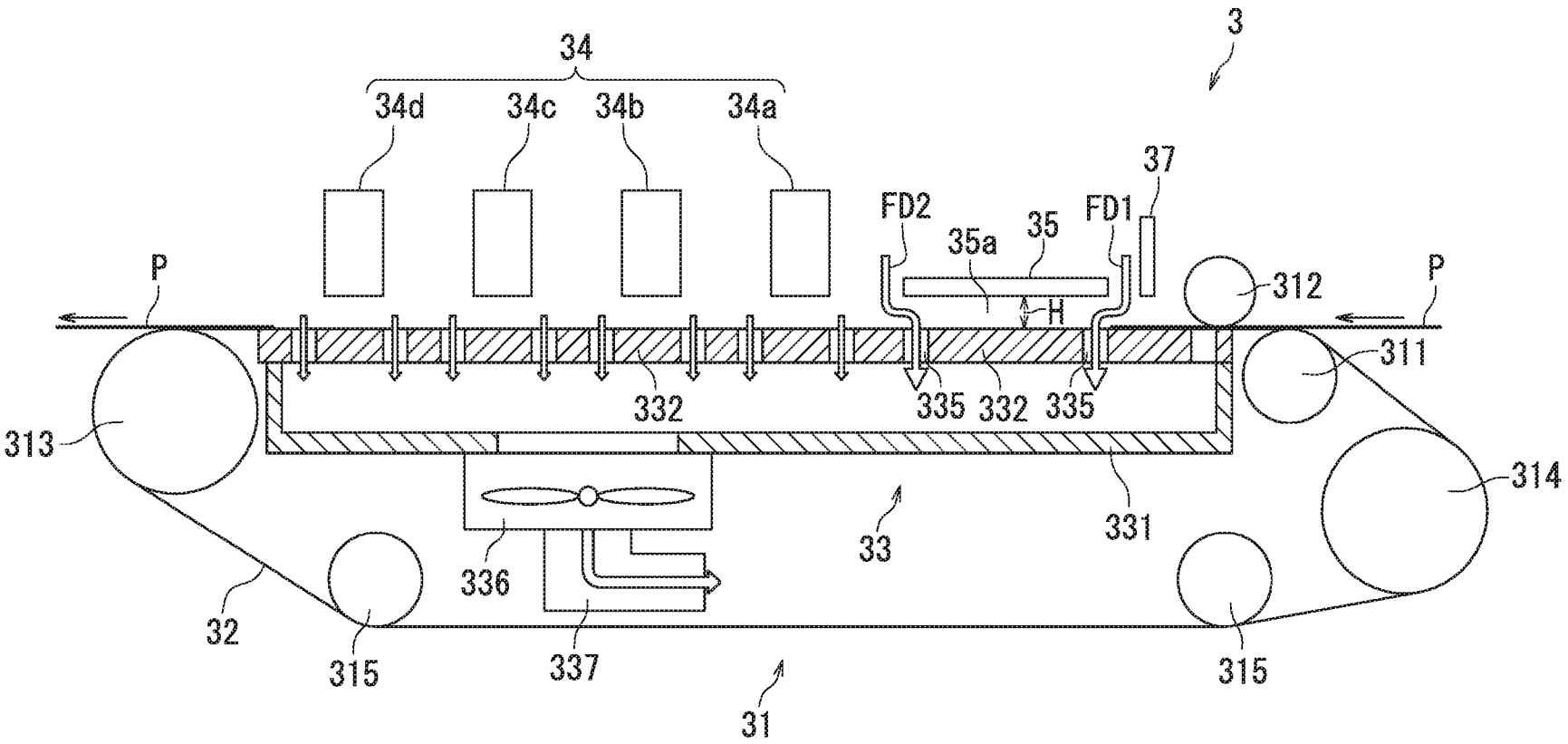
FIG. 10 illustrates an alternative configuration of the image forming section illustrated in FIG. 1.

The following explains another embodiment (referred to below as a "variation") of the present disclosure with reference to the drawings (FIGS. 10-16). The following explains an image forming section 3 with reference to FIG. 10. FIG. 10 illustrates an alternative configuration of the image forming section 3 illustrated in FIG. 1.

The variation illustrated in FIG. 10 differs from the embodiment illustrated in FIG. 2 in terms that the second electrode 38 is omitted. In other words, the image forming section 3 according to the variation includes the conveyance section 31, the negative pressure applying section 33, the recording heads 34, the plate member 35, and the first electrode 37, but does not include the second electrode 38.

Figure 11:
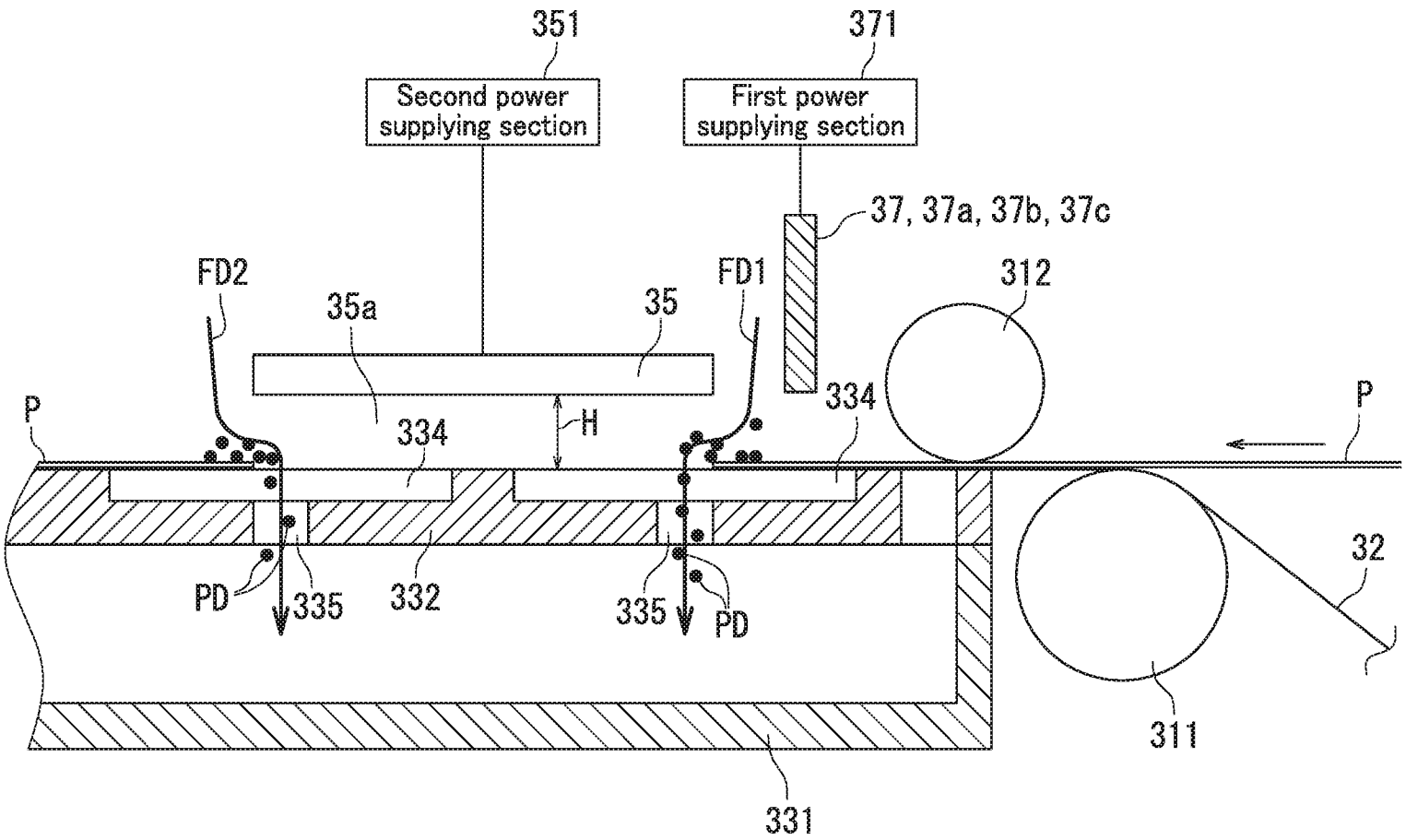
FIG. 11 illustrates configuration around a plate member illustrated in FIG. 10.

The following explains configuration around the plate member 35 with reference to FIG. 11. FIG. 11 illustrates configuration around the plate member 35 illustrated in FIG. 10.

A distance H across the narrow gap 35*a* in the direction perpendicular to the upper surface of the conveyor belt 32 is set such that air flowing into the narrow gap 35*a* from a surrounding region has a higher flow velocity in the narrow gap 35*a* than before flowing into the narrow gap 35*a*. In other words, the distance H is a width (distance) of the narrow gap 35*a* in the vertical direction. More specifically, the lower surface of the plate member 35 and the upper surface of the conveyor belt 32 in conjunction form the narrow gap 35*a* of the distance H in the up-down direction which is set as no greater than a threshold distance HS (for example, 3 mm). The plate member 35 is a conductor (for example, a metal such as stainless steel). The upper surface of the conveyor belt 32, which is in contact with the guide member 332, is equivalent to an example of a "conveyance surface on which a recording medium is placed." In the present variation, the distance H across the narrow gap 35*a* in the up-down direction is, for example, 2 mm.

Although the above explanation with reference to FIG. 11 was given for a situation in which the thickness of the sheet P is sufficiently thin relative to the distance H across the narrow gap 35*a* in the up-down direction, the distance H across the narrow gap 35*a* in the up-down direction is preferably adjusted in accordance with the thickness of the sheet P. More specifically, the plate member 35 is for example preferably raised and lowered in accordance with the thickness of the sheet P such that a distance between the upper surface of the sheet P and the lower surface of the plate member 35 (for example, 2 mm) remains substantially constant.

The following explains air flow around the narrow gap 35*a*. Air flows into the air flow chamber 331 from the narrow gap 35*a*, via the suction holes 321 and the through holes 335, as a result of the air flow chamber 331 being placed in a negative pressure state relative to atmospheric pressure (for example, with a pressure difference relative to atmospheric pressure of approximately 0.005 atm≈approximately 500 Pa) by the negative pressure creating section 336. As a consequence of air flowing into the air flow chamber 331 from the narrow gap 35*a*, air flows into the narrow gap 35*a* from upstream in the conveyance direction of the sheet P (rightward in FIG. 11) relative to the plate member 35 and downstream in the conveyance direction of the sheet P (leftward in FIG. 11) relative to the plate member 35.

Therefore, air flows along arrows FD1 and FD2 illustrated in FIG. 11. The flow velocity of the air increases in the narrow gap 35*a* as a result of the distance H across the narrow gap 35*a* in the up-down direction being set as no greater than the preset threshold distance HS. The flow velocity in the narrow gap 35*a* is, for example, preferably at least 6.0 m/sec.

As explained above, air flowing along the arrow FD1 flows from upstream to downstream in the conveyance direction of the sheet P (leftward in FIG. 11) in the narrow gap 35*a*. Therefore, paper dust PD attached to the leading edge of the sheet P (left edge in FIG. 11) can be removed and collected inside of the air flow chamber 331 as illustrated in FIG. 11. In addition, air flowing along the arrow FD2 flows from downstream to upstream in the conveyance direction of the sheet P (rightward in FIG. 11) in the narrow gap 35*a*. Therefore, paper dust PD attached to the trailing edge of the sheet P (right edge in FIG. 11) can be removed and collected inside of the air flow chamber 331 as illustrated in FIG. 11. The above enables effective removal of paper dust PD attached to the sheet P.

As explained above with reference to FIG. 4, the grooves 334 are present at positions opposite to the plate member 35. Therefore, negative pressure applied from the air flow chamber 331 via the through holes 335 also acts in regions in which the grooves 334 are present. As a result, air can flow more easily along the arrows FD1 and FD2 illustrated in FIG. 11 and paper dust PD can be removed more effectively.

As illustrated in FIG. 11, the first power supplying section 371 and the second power supplying section 351 are provided. The first power supplying section 371 applies a voltage to the sheet P, via the first electrode 37, that is of the same polarity as a charging polarity of the recording heads 34. More specifically, in a situation in which the recording heads 34 are negatively charged, the first power supplying section 371 applies a voltage of, for example, −2.2 kV to the first electrode 37, relative to the grounded guide member 332 as a reference. In the above situation, the sheet P and the paper dust PD are charged to, for example, −70 V.

The second power supplying section 351 applies a voltage to the plate member 35 that is of opposite polarity to the voltage applied by the first power supplying section 371. More specifically, in a situation in which the recording heads 34 are negatively charged, the second power supplying section 351 applies a voltage of, for example, +3.0 kV to the plate member 35, relative to the grounded guide member 332 as a reference. The plate member 35 is positively charged as a result.

As a consequence of the paper dust PD being negatively charged and the plate member 35 being positively charged as described above. Coulomb forces cause the paper dust PD to attach to the plate member 35. Therefore, the paper dust PD can be more effectively removed from the sheet P.

Although the variation of the present disclosure is explained for a configuration in which the paper dust PD is negatively charged and the plate member 35 is positively charged, in an alternative configuration, the paper dust PD may be positively charged and the plate member 35 may be negatively charged.

Furthermore, although the majority of paper dust PD attached to the leading and trailing edges of the sheet P is collected inside of the air flow chamber 331 as described above, through air flowing along the arrows FD1 and FD2, some paper dust PD is not collected inside of the air flow chamber 331. For example, in the case of a central portion of the sheet P, it is difficult for air to flow along the arrows FD1 and FD2 because the sheet P is covering the grooves 334 (through holes 335). However, paper dust PD attached to the central portion of the sheet P can be removed from the sheet P more effectively as a result of the paper dust PD attaching to the plate member 35 due to Coulomb forces.

Furthermore, even if the paper dust PD is conveyed below the recording heads 34, the paper dust PD can be restricted from attaching to the recording heads 34 due to Coulomb forces because the paper dust PD is charged to the same polarity as the recording heads 34. Consequently, the paper dust PD can be effectively restricted from attaching to the recording heads 34.

The recording heads 34 are negatively charged in a situation in which nozzle surfaces (not illustrated) of the recording heads 34 are coated with a fluorine resin. In the above situation, the first power supplying section 371 preferably applies a voltage of, for example, −2.0 kV to the first electrode 37 in order that the electrical potential of the sheet P becomes of substantially the same level and polarity as the electrical potential of the recording heads 34 (for example, −40 V).

Although the variation of the present disclosure is explained for a configuration in which the nozzle surfaces (not illustrated) of the recording heads 34 are negatively charged, in an alternative configuration, the nozzle surfaces (not illustrated) of the recording heads 34 may be positively charged. In the above configuration, the first power supplying section 371 preferably positively charges the paper dust PD. Consequently, the paper dust PD can be effectively restricted from attaching to the recording heads 34.

Figure 12A:
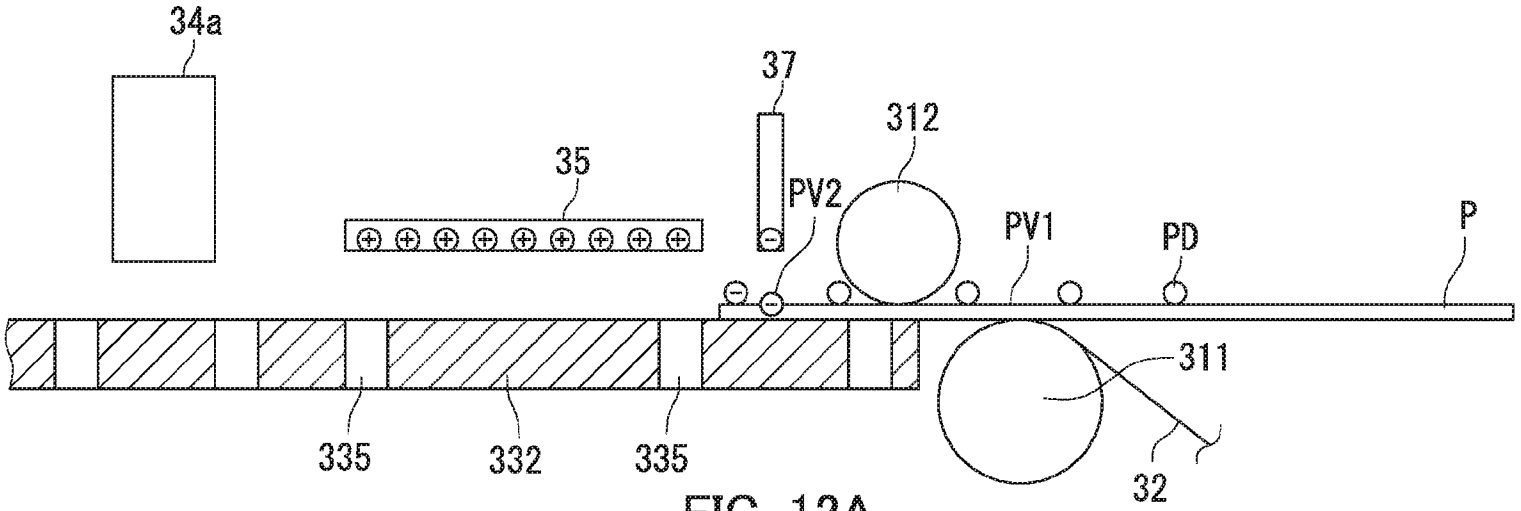
FIGS. 12A and 12B illustrate an example of a process in which an electrode and the plate member illustrated in FIG. 11 collect paper dust.
Figure 12B:
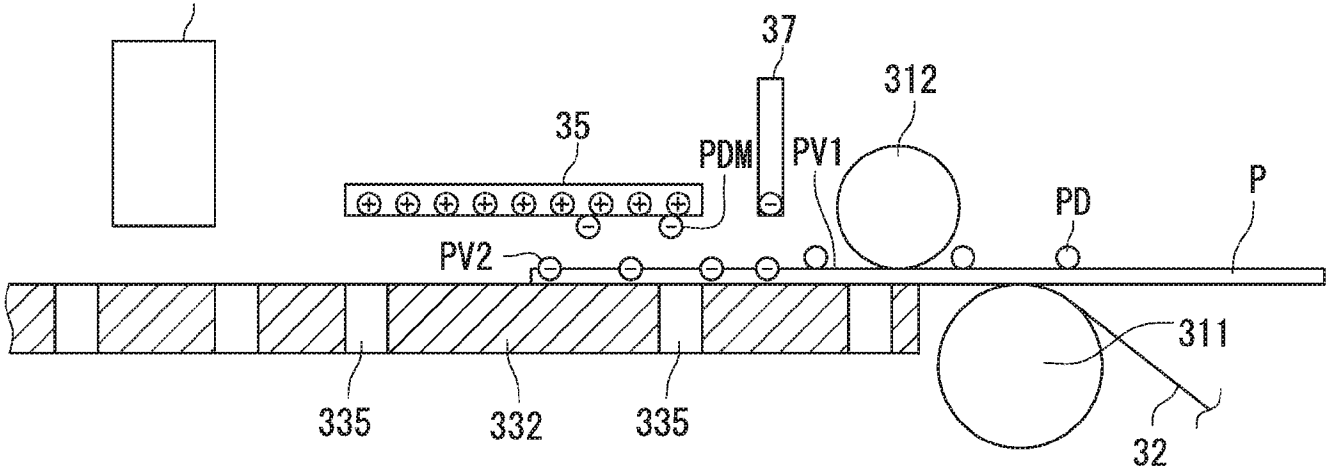
Figure 13A:
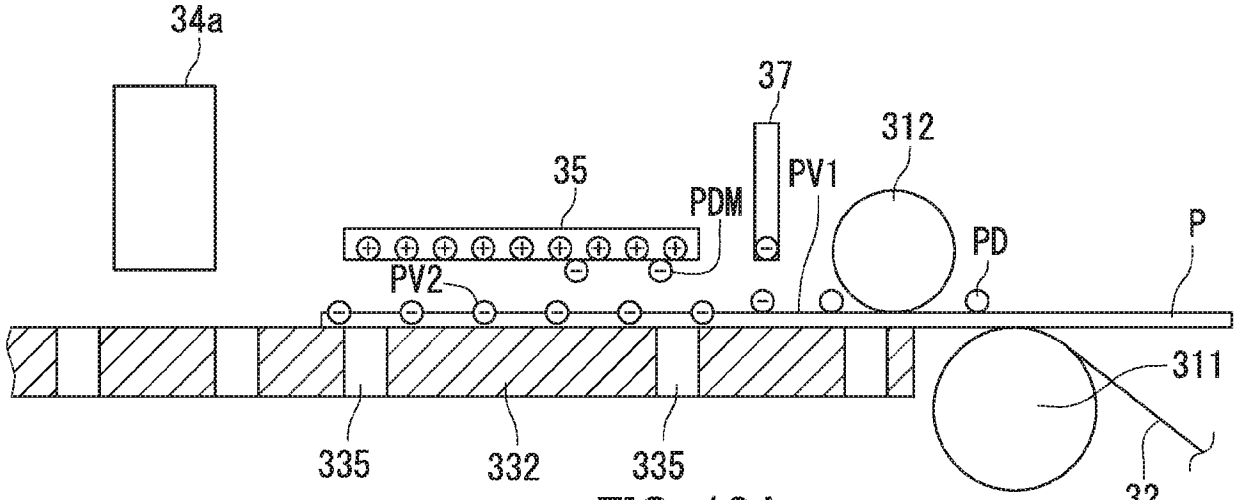
FIGS. 13A and 13B illustrate another example of the process in which the electrode and the plate member illustrated in FIG. 11 collect paper dust.
Figure 13B:
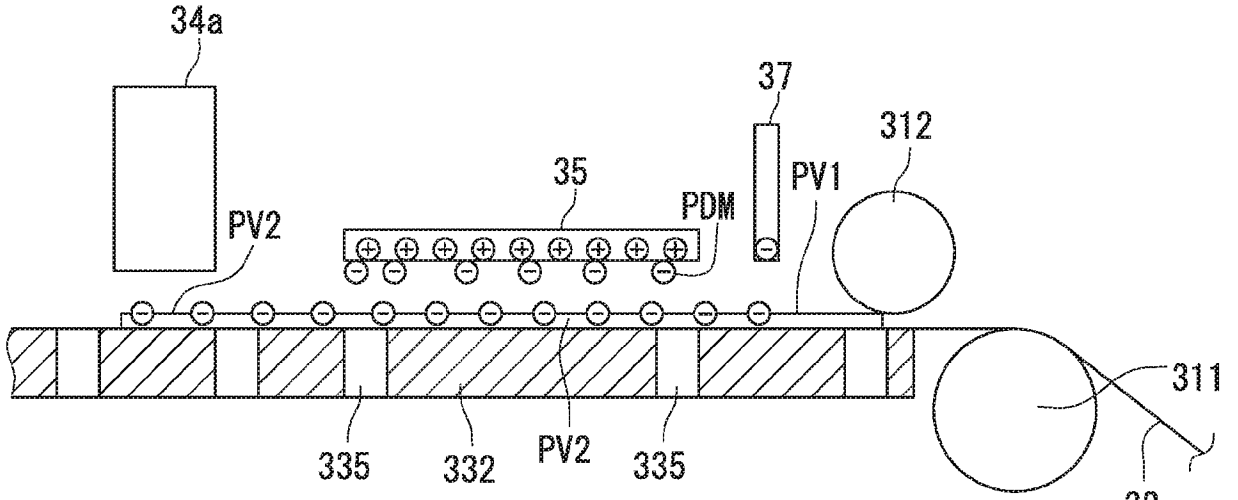

The following refers to FIGS. 12A, 12B, 13A, and 13B to explain change in charging states of the paper dust PD and the sheet P and movement of the paper dust PD as the sheet P is conveyed in the conveyance direction. FIGS. 12A and 12B illustrate an example of change in the charging states of the paper dust PD and the sheet P by the first electrode 37 illustrated in FIG. 11. FIG. 12A illustrates the charging states of the paper dust PD and the sheet P at a point in time at which the leading edge of the sheet P has passed a position below the first electrode 37, whereas FIG. 12B illustrates the charging states of the paper dust PD and the sheet P at a point in time at which the leading edge of the sheet P has reached a position below a central part of the plate member 35. FIGS. 13A and 13B illustrate another example of change in the charging states of the paper dust PD and the sheet P by the first electrode 37 illustrated in FIG. 11. FIG. 13A illustrates the charging states of the paper dust PD and the sheet P at a point in time at which the leading edge of the sheet P has reached a position below a downstream end of the plate member 35 in the sheet conveyance direction, whereas FIG. 13B illustrates the charging states of the paper dust PD and the sheet P at a point in time at which the leading edge of the sheet P has reached a position below the recording head 34*a*. The following explains FIGS. 12A, 12B, 13A, and 13B in order.

As explained with reference to FIG. 11, the first electrode 37 has an applied voltage of, for example, −2.2 kV relative to the grounded guide member 332 as a reference. The plate member 35 has an applied voltage of, for example, +3 kV relative to the grounded guide member 332 as a reference.

FIG. 12A illustrates the charging states of the paper dust PD and the sheet P at a point in time at which the leading edge of the sheet P (left edge in FIG. 12A) has passed the position below the first electrode 37. In the present variation, the paper dust PD and the sheet P are not charged prior to reaching the position below the first electrode 37. In other words, the sheet P has a neutral (±0) charging polarity PV1 prior to reaching the position below the first electrode 37. When the paper dust PD and the sheet P pass below the first electrode 37, the paper dust PD and the sheet P are negatively charged by the first electrode 37. The negatively charged paper dust PD is referred to as "paper dust PDM." After passing under the first electrode 37, the sheet P has a negative charging polarity PV2. Negative charging of the sheet P is indicated in FIGS. 12A, 12B, 13A, and 13B by a minus sign enclosed in a circle shown on the upper surface of the sheet P.

FIG. 12B illustrates the charging states of the paper dust PD and the sheet P at a point in time at which the leading edge of the sheet P has reached the position below the central part of the plate member 35. The negatively charged paper dust PDM is attracted toward the positively charged plate member 35 by Coulomb forces and attaches to the plate member 35. On the other hand, the charging state of the sheet P does not change because discharge does not occur between the plate member 35 and the guide member 332. In other words, the sheet P still has the negative charging polarity PV2 after reaching the position below the central part of the plate member 35.

FIG. 13A illustrates the charging states of the paper dust PD and the sheet P at a point in time at which the leading edge of the sheet P has reached the position below the downstream end of the plate member 35 in the sheet conveyance direction. In the same way as in FIG. 12B, the negatively charged paper dust PDM is attracted toward the positively charged plate member 35 by Coulomb forces and attaches to the plate member 35. On the other hand, the charging state of the sheet P does not change and the sheet P remains negatively charged.

FIG. 13B illustrates the charging states of the paper dust PD and the sheet P at a point in time at which the leading edge of the sheet P has reached the position below the recording head 34*a*. In the same way as in FIG. 12B, the negatively charged paper dust PDM is attracted toward the positively charged plate member 35 by Coulomb forces and attaches to the plate member 35. On the other hand, the charging state of the sheet P does not change and the sheet P remains negatively charged.

As explained above, the paper dust PD is negatively charged by the first electrode 37 and is attracted toward the positively charged plate member 35 by Coulomb forces, resulting in attachment of the paper dust PD to the plate member 35. Therefore, the paper dust PD can be more effectively removed from the sheet P.

The paper dust PD is negatively charged by the first electrode 37. Therefore, even if the paper dust PD is conveyed below the recording heads 34, the paper dust PD can be restricted from attaching to the recording heads 34 due to Coulomb forces because the paper dust PD is negatively charged to the same polarity as the recording heads 34. Consequently, the paper dust PD can be effectively restricted from attaching to the recording heads 34.

Figure 14:
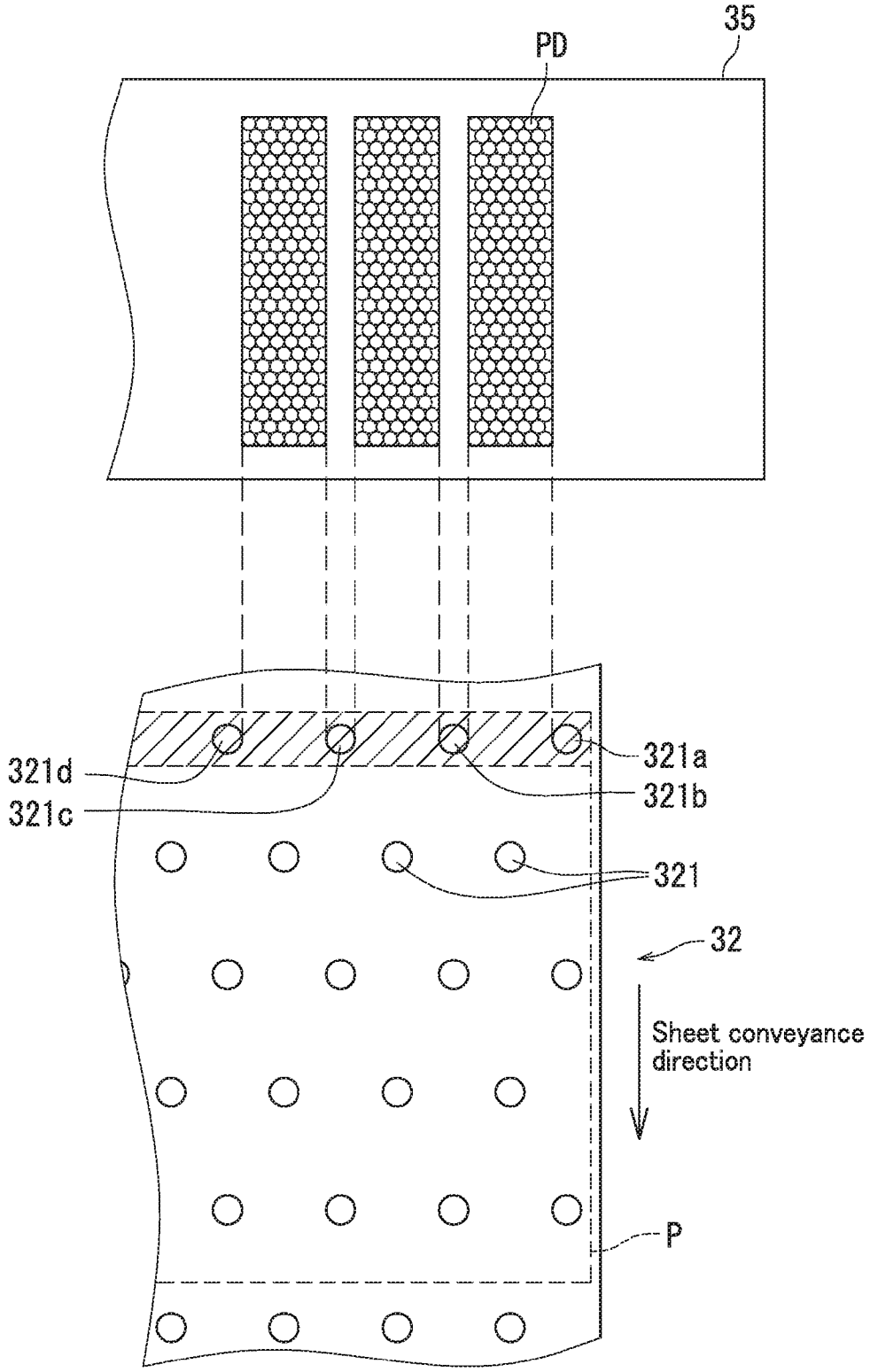
FIG. 14 illustrates a relationship between positions at which paper dust attaches to the plate member illustrated in FIGS. 12A, 12B, 13A, and 13B and positions of suction holes in a conveyor belt. The upper part of FIG. 14 is a lower surface view of the positions at which the paper dust attaches to the plate member. The lower part of FIG. 14 is a plan view illustrating the positions of the suction holes in the conveyor belt.
Figure 15A:
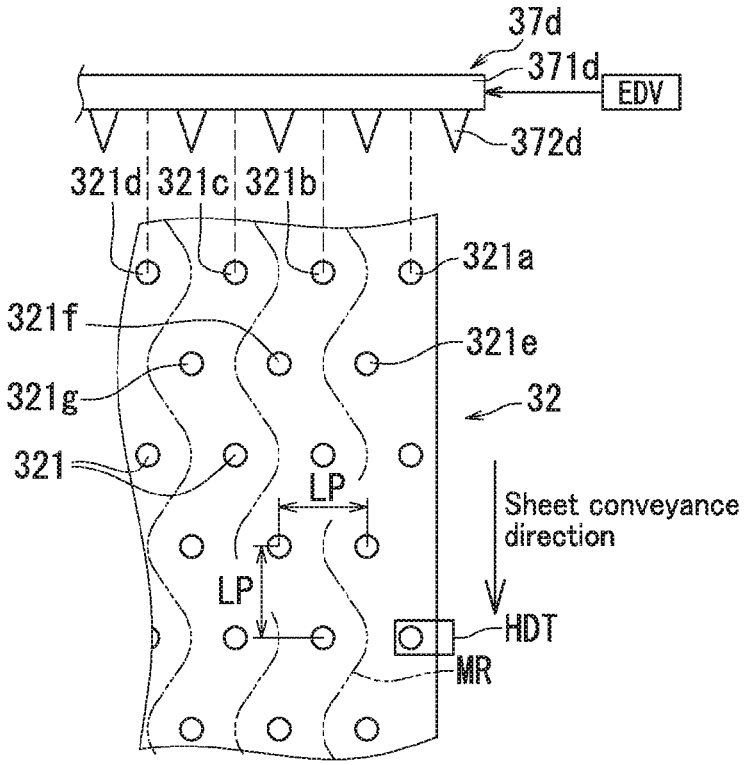
FIGS. 15A and 15B illustrate a relationship between positions of discharge portions of the electrode illustrated in FIG. 11 and positions of the suction holes in the conveyor belt.
Figure 15B:
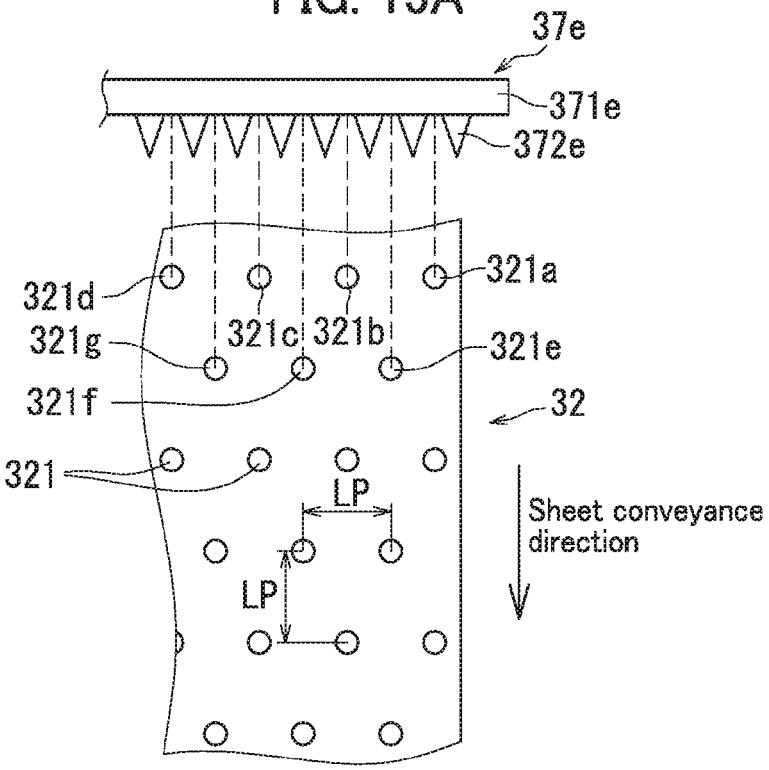
Figure 16:
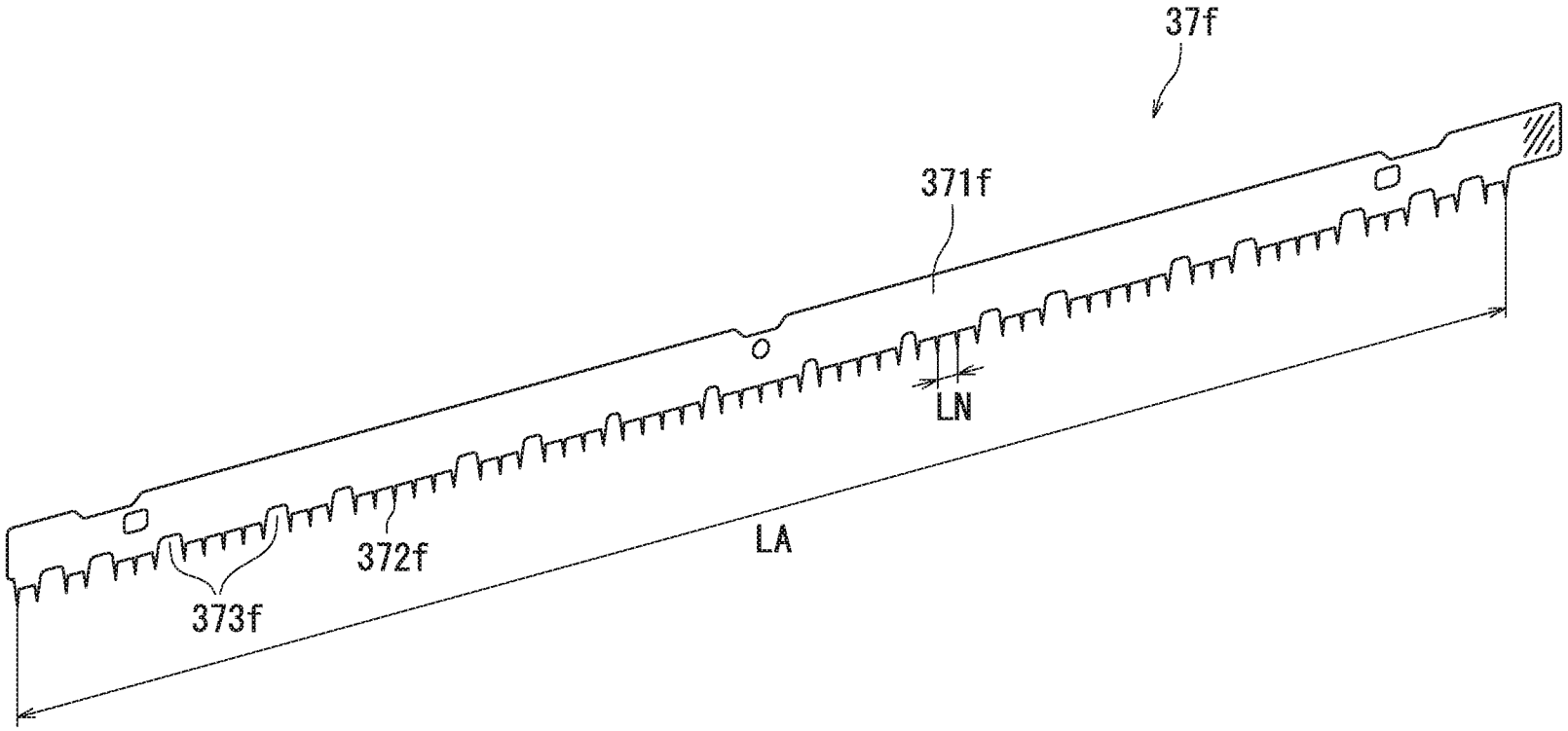
FIG. 16 is a perspective view illustrating a third embodiment of the electrode illustrated in FIG. 11.

The following refers to FIGS. 14-16 to explain intervals between needles of the needle electrode that forms the first electrode 37 illustrated in FIG. 11. FIG. 14 illustrates a relationship between positions at which paper dust PD attaches to the plate member 35 illustrated in FIGS. 12A, 12B, 13A, and 13B, and positions of the suction holes 321 in the conveyor belt 32. The upper part of FIG. 14 is a lower surface view of the positions at which the paper dust PD attaches to the plate member 35. The lower part of FIG. 14 is a plan view illustrating the positions of the suction holes 321 in the conveyor belt 32.

The upper part of FIG. 14 illustrates a state in which paper dust PD that was attached to a hatched portion of the sheet P (refer to the lower part of FIG. 14) has attached to the plate member 35. As illustrated in the lower part of FIG. 14, the hatched portion of the sheet P is located on a region of the conveyor belt 32 that, in terms of the conveyance direction, corresponds to one row of suction holes 321*a*, 321*b*. 321*c*, and 321*d* that are arranged along the conveyor belt 32 in the width direction (left-right direction in FIG. 14). Paper dust PD attached to the sheet P at positions corresponding to the suction holes 321*a*, 321*b*. 321*c*, and 321*d* illustrated in the lower part of FIG. 14 is not collected by the plate member 35, as illustrated in the upper part of FIG. 14.

The paper dust PD is sucked toward the sheet P (toward the conveyor belt 32) due to the negative pressure applied to the suction holes 321 by the negative pressure applying section 33 (refer to FIG. 3). Therefore, as illustrated in the upper part of FIG. 14, the paper dust PD attached to the sheet P around the suction holes 321*a*, 321*b*, 321*c*, and 321*d* does not attach to the plate member 35.

The following explains configuration of the first electrode 37 with reference to FIGS. 15A and 15B. FIGS. 15A and 15B illustrate a relationship between positions of discharge portions 372 of the first electrode 37 illustrated in FIG. 11 and positions of the suction holes 321 in the conveyor belt 32. FIG. 15A illustrates a first embodiment of the first electrode 37. FIG. 15B illustrates a second embodiment of the first electrode 37.

The upper part of FIG. 15A is a front view illustrating a first electrode 37*d* according to the first embodiment. The upper part of FIG. 15B is a front view illustrating a first electrode 37*e* according to the second embodiment. The lower parts of FIGS. 15A and 15B are plan views illustrating the positions of the suction holes 321 in the conveyor belt 32.

As illustrated in the lower parts of FIGS. 15A and 15B, the suction holes 321*a*, 321*b*, 321*c*, and 321*d* composing a first row and suction holes 321*e*, 321*f*, and 321*g* composing a second row are arranged along the conveyor belt 32 in the width direction (left-right direction in the lower parts of FIGS. 15A and 15B). The suction holes 321*a*, 321*b*. 321*c*, and 321*d* composing the first row and the suction holes 321*e*, 321*f*, and 321*g* composing the second row are arranged at equal intervals (constant intervals LP). The suction holes 321 are in staggered rows in the conveyor belt 32. In other words, relative to the suction holes 321*a*. 321*b*, 321*c*, and 321*d* composing the first row, the suction holes 321*e*, 321*f*, and 321*g* composing the second row are shifted in the width direction of the conveyor belt 32 by a distance equivalent to half the interval LP. First rows of suction holes 321 and second rows of suction holes 321 described above are provided alternately at equal intervals (constant intervals LP) in the conveyance direction of the sheet P (downward in the lower parts of FIGS. 15A and 15B). The interval LP is for example 40 mm.

As illustrated in the upper part of FIG. 15A, the first electrode 37*d* is a so-called "needle electrode." More specifically, the first electrode 37*d* includes a base 371*d* and discharge portions 372*d*. The base 371*d* is a plate member that is made from a metal such as stainless steel. The discharge portions 372*d* are arranged at a lower edge of the base 371*d* (edge close to the conveyor belt 32) and each have a sharp tip (end close to the conveyor belt 32) like a needle. The base 371*d* and the discharge portions 372*d* have an integrated structure. Each of the discharge portions 372*d* is equivalent to a "needle."

Relative to the suction holes 321*a*, 321*b*, 321*c*, and 321*d* composing the first row, the discharge portions 372*d* are located opposite to central positions between adjacent suction holes 321.

Therefore, when the suction holes 321*a*, 321*b*, 321*c*, and 321*d* composing the first row in the conveyor belt 32 pass below the first electrode 37, paper dust PD attached to the upper surface of the conveyor belt 32 and the sheet P can be efficiently charged because the discharge portions 372*d* are located opposite to the central positions between the adjacent suction holes 321. As a result, the paper dust PD can be effectively removed from the sheet P.

Although the above explanation is for a configuration in which the first electrode 37*d* is fixed in position, in an alternative configuration, the first electrode 37*d* may be moveable in the width direction of the conveyor belt 32. More specifically, a hole detector HDT and an electrode driving section EDV are provided. The hole detector HDT detects suction holes 321 located at a periphery of the conveyor belt 32 in the width direction. The electrode driving section EDV moves the first electrode 37*d* in the width direction of the conveyor belt 32 based on a detection result of the hole detector HDT. The electrode driving section EDV moves the electrode 37*d* in the width direction of the conveyor belt 32 such that one or more of the discharge portions 372*d* are located opposite to a region of the conveyor belt 32 between adjacent suction holes 321. The hole detector HDT is for example a transmission hole detector or a reflection hole detector. The electrode driving section EDV is for example a motor. Each track MR illustrated in FIG. 15A is a track of a position on the conveyor belt 32 directly below a corresponding discharge portion 372*d*.

In the above configuration, one or more of the discharge portions 372*d* are located opposite to the region of the conveyor belt 32 between adjacent suction holes 321. Therefore, the paper dust PD attached to the upper surface of the conveyor belt 32 and the sheet P can be efficiently charged even when the suction holes 321*e*, 321*f*, and 321*g* composing the second row pass below the first electrode 37*d*. As a result, the paper dust PD can be more effectively removed from the sheet P.

The following explains the first electrode 37*e* according to the second embodiment with reference to FIG. 15B. The first electrode 37*e* according to the second embodiment differs from the first electrode 37*d* according to the first embodiment in terms that a larger number of discharge portions (approximately twice as many) are provided. As illustrated in the upper part of FIG. 15B, the first electrode 37*e* is a so-called "needle electrode." More specifically, the first electrode 37*e* includes a base 371*e* and discharge portions 372*e*. The base 371*e* is a plate member that is made from a metal such as stainless steel. The discharge portions 372*e* are arranged at a lower edge of the base 371*e* (edge close to the conveyor belt 32) and each have a sharp tip (end close to the conveyor belt 32) like a needle. The base 371*e* and the discharge portions 372*e* have an integrated structure. Each of the discharge portions 372*e* is an example of a "needle."

The discharge portions 372*e* are arranged at positions that, in a situation in which the suction holes 321*a*, 321*b*, 321*c*, and 321*d* composing the first row and the suction holes 321*e*, 321*f*, and 321*g* composing the second row are considered as a single row, are opposite to central positions between adjacent suction holes 321.

Therefore, when the suction holes 321 in the conveyor belt 32 pass below the first electrode 37*e*, the paper dust PD attached to the upper surface of the conveyor belt 32 and the sheet P can be efficiently charged because the discharge portions 372*e* are located opposite to the central positions between adjacent suction holes 321.

The following explains a first electrode 37*f* according to a third embodiment with reference to FIG. 16. The first electrode 37*f* according to the third embodiment differs from the first electrode 37*e* according to the second embodiment in terms that an even larger number of discharge portions are provided. FIG. 16 is a perspective view illustrating the third embodiment of the electrode 37 illustrated in FIG. 11. As illustrated in FIG. 16, the first electrode 37*f* is a so-called "needle electrode."

More specifically, the first electrode 37*f* includes a base 371*f* and discharge portions 372*f*. The base 371*f* is a plate member made from a metal such as stainless steel. The discharge portions 372*f* are arranged along a lower edge of the base 371*f* (edge close to the guide member 332) and each have a sharp tip (end close to the conveyor belt 32) like a needle. The base 371*f* and the discharge portions 372*f* have an integrated structure. Each of the discharge portions 372*f* is an example of a "needle."

The discharge portions 372*f* are arranged at substantially equal intervals such that an interval LN between adjacent discharge portions 372*f* is sufficiently small relative the interval LP between adjacent suction holes 321; the interval LN is for example 4 mm. The base 371*f* has recesses 373*f* that are used to support the first electrode 37*f*. A distance LA between discharge portions 372*f* located at opposite ends of the base 371*f* is at least as large as the width of a largest sheet P on which the inkjet recording apparatus 1 can perform printing.

As a result of the first electrode 37*f* being a needle electrode as described above, the paper dust PD and the sheet P can be efficiently charged.

Although the first to third embodiments of the variation are explained for a configuration in which the first electrode 37 is a needle electrode, the aforementioned configuration is not a limitation. In other words, the first electrode 37 may be a different type of electrode. For example, in an alternative configuration, the first electrode 37 may be a driven roller that is driven while in contact with the conveyor belt 32. In the above configuration, the paper dust PD and the sheet P can be charged more efficiently because electricity is passed through the first electrode 37 while in contact with the sheet P.

Through the above, an embodiment and a variation of the present disclosure have been explained with reference to the drawings. However, the present disclosure is not limited by the above embodiment and variation and can be implemented in various forms without deviating from the essence of the present disclosure (for example, as explained below in sections (1)-(4)). The drawings schematically illustrate elements in order to facilitate understanding. Properties of the elements illustrated in the drawings, such as thickness, length, and quantity, may differ from reality in order to facilitate preparation of the drawings. Furthermore, properties of the elements described in the above embodiment, such as shape and dimensions, are merely examples and are not intended to be specific limitations. Such properties can be changed without substantially deviating from the configuration of the present disclosure.

(1) Although the above embodiment of the present disclosure is explained for a configuration in which the sheet P is conveyed by the conveyor belt 32 in the image forming section 3, the aforementioned configuration is not a limitation. That is, in an alternative configuration, the sheet P may be conveyed by a different method in the image forming section 3. For example, in an alternative configuration, the sheet P may be conveyed by conveyance rollers. In the above configuration, negative pressure is preferably applied from between adjacent conveyance rollers.

(2) Although the above embodiment of the present disclosure is explained for a configuration in which the narrow gap 35*a* is formed by the plate member 35, the aforementioned configuration is not a limitation. That is, in an alternative configuration, the narrow gap 35*a* may be formed in a different manner. For example, in an alternative configuration, a head base that supports the recording heads 34 may extend toward the conveyor belt 32 at a position upstream of the recording heads 34 in the conveyance direction of the sheet P and may thereby form the narrow gap 35*a*. The above configuration can simplify structure. The head base receives an applied voltage from the second power supplying section 351 and is therefore preferably made from a conductive material (for example, a metal such as stainless steel). In the above configuration, the recording heads 34 are preferably insulated from the head base in order that the voltage applied to the head base does not affect the recording heads 34.

In another alternative example, the narrow gap 35*a* may be formed by a belt stretched around two rollers instead of by the plate member 35. More specifically, a drive roller and a driven roller that are substantially parallel to the upper surface of the conveyor belt 32 and an endless belt stretched around the drive roller and the driven roller are provided such that a lower surface of the endless belt forms the narrow gap 35*a* in conjunction with the upper surface of the conveyor belt 32. In the above configuration, the endless belt preferably has an adhesive outer circumferential surface in order to collect paper dust floating inside of the narrow gap 35*a*. When paper dust becomes attached to the lower surface of the endless belt, the endless belt can be driven to circulate such that a surface section to which paper dust is not attached becomes positioned as the lower surface, and thereby, for example, the frequency with which a servicing technician needs to remove paper dust attached to the endless belt can be reduced. The driven roller and the endless belt are preferably made from a conductive material (for example, a metal such as stainless steel). The second power supplying section 351 preferably applies a voltage to the endless belt via the driven roller. In the above configuration, paper dust PD can be removed more effectively because the paper dust PD attaches to the endless belt due to Coulomb forces.

(3) Although the above variation of the present disclosure is explained for a configuration in which the sheet P is conveyed by the conveyor belt 32 in the image forming section 3, the aforementioned configuration is not a limitation. That is, in an alternative configuration, the sheet P may be conveyed by a different method in the image forming section 3. For example, the sheet P may be conveyed by conveyance rollers. In the above configuration, negative pressure is preferably applied from between adjacent conveyance rollers.

(4) Although the above variation of the present disclosure is explained for a configuration in which the narrow gap 35*a* is formed by the plate member 35, the aforementioned configuration is not a limitation. That is, in an alternative configuration, the narrow gap 35*a* may be formed in a different manner. For example, in an alternative configuration, a head base that supports the recording heads 34 may extend toward the conveyor belt 32 at a position upstream of the recording heads 34 in the conveyance direction of the sheet P and may thereby form the narrow gap 35*a*. The above configuration can simplify structure. The head base receives an applied voltage from the second power supplying section 351 and is therefore preferably made from a conductive material (for example, a metal such as stainless steel). In the above configuration, the recording heads 34 are preferably insulated from the head base in order that the voltage applied to the head base does not affect the recording heads 34.

In another alternative example, the narrow gap 35*a* may be formed by a belt stretched around two rollers instead of by the plate member 35. More specifically, a drive roller and a driven roller that are substantially parallel to the upper surface of the conveyor belt 32 and an endless belt stretched around the drive roller and the driven roller are provided such that a lower surface of the endless belt forms the narrow gap 35*a* in conjunction with the upper surface of the conveyor belt 32. In the above configuration, the endless belt preferably has an adhesive outer circumferential surface in order to collect paper dust floating inside of the narrow gap 35*a*. When paper dust becomes attached to the lower surface of the endless belt, the endless belt can be driven to circulate such that a surface section to which paper dust is not attached becomes positioned as the lower surface, and thereby, for example, the frequency with which a servicing technician needs to remove paper dust attached to the endless belt can be reduced. The driven roller and the endless belt are preferably made from a conductive material (for example, a metal such as stainless steel). The second power supplying section 351 preferably applies a voltage to the endless belt via the driven roller. In the above configuration, paper dust PD can be removed more effectively because the paper dust PD attaches to the endless belt due to Coulomb forces.

What is claimed is:

1. An inkjet recording apparatus comprising:

a recording head configured to eject ink onto a recording medium;

a conveyance section configured to convey the recording medium to a position of image forming by the recording head;

a first voltage applying section configured to apply a voltage to the recording medium upstream of the recording head in a conveyance direction of the recording medium; and a second voltage applying section including a gap forming section located between the recording head and the first voltage applying section and configured to apply, to a lower surface of the gap forming section, a voltage that is of opposite polarity to the voltage applied by the first voltage applying section, wherein the gap forming section forms a narrow gap in conjunction with a conveying surface of the conveyance section on which the recording medium is placed, and the voltage applied to the recording medium by the first voltage applying section is of the same polarity as a charging polarity of the recording head.

2. The inkjet recording apparatus according to claim 1, wherein the first voltage applying section includes a needle electrode and applies the voltage to the recording medium via the needle electrode.

3. The inkjet recording apparatus according to claim 1, wherein the voltage applied to the recording medium by the first voltage applying section is set such that a charging voltage of the recording medium is substantially the same level as a charging voltage of the recording head.

4. The inkjet recording apparatus according to claim 1, wherein the gap forming section includes a plate member that is located opposite to the conveying surface of the conveyance section on which the recording medium is placed and that has a flat surface that is substantially parallel to the conveying surface, and the voltage applied by the second voltage applying section, which is of opposite polarity to the voltage applied by the first voltage applying section, is applied to the plate member.

5. The inkjet recording apparatus according to claim 1, further comprising a third voltage applying section located between the recording head and the gap forming section and configured to apply, to the recording medium, a voltage of opposite polarity to the voltage applied by the first voltage applying section.

6. The inkjet recording apparatus according to claim 5, wherein the third voltage applying section includes a needle electrode and applies the voltage to the recording medium via the needle electrode.

7. The inkjet recording apparatus according to claim 5, wherein the voltage applied to the recording medium by the third voltage applying section is set such that a charging voltage of the recording medium is substantially the same level as a charging voltage of the recording head when the recording medium reaches a position directly below the recording head.

8. The inkjet recording apparatus according to claim 4, wherein the plate member is a conductor.

9. The inkjet recording apparatus according to claim 1, further comprising a negative pressure applying section configured to apply negative pressure to the recording medium.

10. The inkjet recording apparatus according to claim 9, wherein the conveyance section includes an endless belt on which the recording medium is placed, the endless belt has a plurality of holes through which the negative pressure applied by the negative pressure applying section sucks the recording medium, the first voltage applying section includes a needle electrode and applies the voltage to the recording medium via the needle electrode, and one or more needles of the needle electrode are located opposite to a region of the endless belt between adjacent holes among the plurality of holes.

11. The inkjet recording apparatus according to claim 10, wherein the plurality of holes are arranged in staggered rows in the endless belt, and relative to holes, among the plurality of holes in the endless belt, arranged in two rows that are adjacent in the conveyance direction of the recording medium, one or more needles of the needle electrode are located opposite to a region of the endless belt, in a width direction thereof, in which none of the holes in the two rows are located.

12. The inkjet recording apparatus according to claim 10, wherein the plurality of holes are arranged in staggered rows in the endless belt, the inkjet recording apparatus further comprises:

a hole detector configured to detect a hole, among the plurality of holes in the endless belt, located at a periphery of the endless belt in a width direction thereof; and an electrode driving section configured to move the needle electrode in the width direction of the endless belt based on a detection result of the hole detector, and the electrode driving section moves the needle electrode in the width direction of the endless belt such that one or more needles of the needle electrode are located opposite to a region of the endless belt between adjacent holes among the plurality of holes.

13. The inkjet recording apparatus according to claim 9, wherein the voltage applied to the recording medium by the first voltage applying section is of the same polarity as a charging polarity of the recording head.

14. The inkjet recording apparatus according to claim 9, wherein the gap forming section forms the narrow gap such that a distance across the narrow gap in a direction perpendicular to the conveying surface is no greater than a threshold distance.

15. The inkjet recording apparatus according to claim 9, wherein the gap forming section includes a plate member that is located opposite to the conveying surface of the conveyance section on which the recording medium is placed and that has a flat surface that is substantially parallel to the conveying surface, and the voltage applied by the second voltage applying section, which is of opposite polarity to the voltage applied by the first voltage applying section, is applied to the plate member.

16. The inkjet recording apparatus according to claim 15, wherein the plate member is a conductor.

* * * * *